US008727048B2

(12) United States Patent
Jurkiewicz et al.

(10) Patent No.: US 8,727,048 B2
(45) Date of Patent: May 20, 2014

(54) WHEELCHAIR

(75) Inventors: Damon Jurkiewicz, Cleveland, OH (US); Joshua Greiner, Columbus, OH (US); Daniel James Yee, Parma, OH (US); Daniel Watson, Cleveland, OH (US); Traian Mohan, Parma, OH (US); Robert Bekoscke, Medina, OH (US)

(73) Assignee: Invacare Corp., Elyria, OH (US)

( * ) Notice: Subject to any disclaimer, the term of this patent is extended or adjusted under 35 U.S.C. 154(b) by 0 days.

(21) Appl. No.: 13/505,630

(22) PCT Filed: Nov. 15, 2010

(86) PCT No.: PCT/US2010/056663

§ 371 (c)(1), (2), (4) Date: May 2, 2012

(87) PCT Pub. No.: WO2011/060345

PCT Pub. Date: May 19, 2011

(65) Prior Publication Data

US 2012/0223514 A1 Sep. 6, 2012

Related U.S. Application Data

(60) Provisional application No. 61/261,359, filed on Nov. 15, 2009, provisional application No. 61/314,314, filed on Mar. 16, 2010.

(51) Int. Cl.
*A61G 5/04* (2013.01)
*A61G 5/10* (2006.01)

(52) U.S. Cl.
USPC ..... 180/65.1; 180/907; 280/250.1; 280/798; 280/281.1

(58) Field of Classification Search
USPC ..... 280/798, 250.1, 281.1; 180/65.1, 65.51, 180/216, 907
See application file for complete search history.

(56) References Cited

U.S. PATENT DOCUMENTS

| | | | |
|---|---|---|---|
| D231,801 | S | 6/1974 | Pivacek |
| 3,865,427 | A | 2/1975 | Delany |

(Continued)

FOREIGN PATENT DOCUMENTS

| | | |
|---|---|---|
| FR | 2845893 | 4/2004 |
| WO | 94/11235 | 5/1994 |

(Continued)

OTHER PUBLICATIONS

International Search Report and Written Opinion for PCT/US2010/05663 dated Jun. 15, 2011.

(Continued)

*Primary Examiner* — Ruth Ilan
*Assistant Examiner* — George Spisich
(74) *Attorney, Agent, or Firm* — Calfee, Halter & Griswold, LLP

(57) ABSTRACT

A conveyance such as a wheelchair that includes a seat assembly and a chassis. The chassis comprises a central frame member disposed substantially along the centerline of the wheelchair. The central frame member includes portions for connecting to or supporting one or more front casters, a seat assembly, one or more drive wheel assemblies, an energy source (e.g., one or more batteries), rear anti-tip wheels, and/or at least one footplate. The central frame member is disposed substantially along the centerline of the wheelchair and structurally distributes of the weight of the seat assembly (and optionally the weight of the energy source) to the supporting drive wheels and casters. In this manner, a clean-looking, simple, and lightweight chassis structure is provided for a conveyance.

11 Claims, 28 Drawing Sheets

(56) References Cited

U.S. PATENT DOCUMENTS

| | | | | |
|---|---|---|---|---|
| 4,025,112 | A | 5/1977 | Hale | |
| 4,037,676 | A | 7/1977 | Ruse | |
| 4,643,446 | A * | 2/1987 | Murphy et al. | 280/648 |
| 4,961,610 | A | 10/1990 | Reeder et al. | |
| 5,018,788 | A | 5/1991 | Cedergreen | |
| 5,033,792 | A | 7/1991 | Kanazawa | |
| 5,137,102 | A | 8/1992 | Houston, Sr. et al. | |
| D333,737 | S | 3/1993 | Adams | |
| 5,209,322 | A * | 5/1993 | McMahon | 180/271 |
| 5,275,466 | A | 1/1994 | Rentchler, Jr. | |
| 5,301,964 | A * | 4/1994 | Papac | 280/250.1 |
| 5,366,037 | A | 11/1994 | Richey | |
| 5,382,036 | A | 1/1995 | Counts et al. | |
| D365,787 | S | 1/1996 | Peterson et al. | |
| 5,480,179 | A * | 1/1996 | Peacock | 280/650 |
| 5,495,904 | A | 3/1996 | Zwaan et al. | |
| 5,573,260 | A * | 11/1996 | Peterson et al. | 280/250.1 |
| D380,991 | S | 7/1997 | Deming | |
| 5,820,221 | A | 10/1998 | Greaves et al. | |
| D414,453 | S | 9/1999 | Tsai | |
| 5,996,716 | A * | 12/1999 | Montiglio et al. | 180/65.51 |
| 6,003,891 | A | 12/1999 | Broadhead | |
| 6,015,190 | A | 1/2000 | Wend | |
| 6,092,822 | A * | 7/2000 | Salmon | 280/261 |
| 6,095,271 | A * | 8/2000 | Dickie et al. | 180/68.5 |
| 6,206,119 | B1 * | 3/2001 | Wu | 180/65.1 |
| 6,206,393 | B1 * | 3/2001 | Mascari et al. | 280/220 |
| 6,352,273 | B1 | 3/2002 | Dickie | |
| 6,386,638 | B1 | 5/2002 | Strauch | |
| 6,394,476 | B1 * | 5/2002 | Molnar | 280/250.1 |
| D462,639 | S | 9/2002 | Lin | |
| 6,459,962 | B2 | 10/2002 | Ulrich et al. | |
| D468,669 | S | 1/2003 | Hopely, Jr. | |
| D477,261 | S | 7/2003 | Lin | |
| 6,669,299 | B2 | 12/2003 | Carlson et al. | |
| D486,762 | S | 2/2004 | He | |
| D491,115 | S | 6/2004 | Taylor | |
| D491,494 | S | 6/2004 | Lippert | |
| D494,110 | S | 8/2004 | Cheng | |
| 6,938,923 | B2 | 9/2005 | Mulhern et al. | |
| D521,909 | S | 5/2006 | Gillett et al. | |
| 7,040,429 | B2 | 5/2006 | Molnar | |
| D523,788 | S | 6/2006 | Jones et al. | |
| D524,196 | S | 7/2006 | You | |
| D529,844 | S | 10/2006 | Chen et al. | |
| D536,187 | S | 2/2007 | Goebert et al. | |
| D536,887 | S | 2/2007 | Goebert et al. | |
| D540,221 | S | 4/2007 | Cartellone et al. | |
| 7,204,556 | B2 | 4/2007 | Schwerdtner et al. | |
| 7,229,132 | B2 | 6/2007 | Meeker et al. | |
| 7,306,247 | B2 * | 12/2007 | Wu | 280/124.128 |
| D559,741 | S | 1/2008 | Lasher, III | |
| 7,342,123 | B2 | 3/2008 | Jansen et al. | |
| D569,769 | S | 5/2008 | Chiu et al. | |
| 7,370,876 | B2 | 5/2008 | Hsu et al. | |
| 7,413,045 | B2 | 8/2008 | Tien | |
| 7,472,959 | B1 | 1/2009 | Ratza et al. | |
| D585,794 | S | 2/2009 | Lin | |
| D589,411 | S | 3/2009 | Brown et al. | |
| D590,304 | S | 4/2009 | Kruse | |
| D608,550 | S | 1/2010 | Sollberger et al. | |
| D614,541 | S | 4/2010 | Storm | |
| 7,694,991 | B2 | 4/2010 | Mills et al. | |
| D615,461 | S | 5/2010 | Storm | |
| 7,766,106 | B2 * | 8/2010 | Puskar-Pasewicz et al. | 180/65.1 |
| D632,229 | S | 2/2011 | Kruse | |
| 8,297,388 | B2 * | 10/2012 | Lindenkamp et al. | 180/65.1 |
| 2001/0013437 | A1 | 8/2001 | Husted et al. | |
| 2003/0006578 | A1 * | 1/2003 | Melgarejo et al. | 280/250.1 |
| 2003/0056329 | A1 | 3/2003 | Coman et al. | |
| 2004/0188152 | A1 * | 9/2004 | Schaffner | 180/65.1 |
| 2004/0239169 | A1 | 12/2004 | DeNichilo | |
| 2005/0075758 | A1 | 4/2005 | Wakefield | |
| 2005/0076436 | A1 | 4/2005 | Hahn et al. | |
| 2005/0080518 | A1 | 4/2005 | Wakefield | |
| 2005/0279539 | A1 * | 12/2005 | Chiou et al. | 180/65.1 |
| 2006/0082098 | A1 | 4/2006 | Harris | |
| 2007/0107963 | A1 | 5/2007 | Chiu | |
| 2007/0195081 | A1 | 8/2007 | Fischer | |
| 2007/0216131 | A1 * | 9/2007 | Potappel | 280/250.1 |
| 2008/0041282 | A1 | 2/2008 | Goschy et al. | |
| 2008/0087481 | A1 | 4/2008 | Grymko et al. | |
| 2009/0078482 | A1 * | 3/2009 | Kylstra | 180/65.1 |
| 2011/0316253 | A1 | 12/2011 | Tuckowski | |

FOREIGN PATENT DOCUMENTS

| | | |
|---|---|---|
| WO | 97/46516 | 12/1997 |
| WO | 03/045299 | 6/2003 |
| WO | WO 03/045299 * | 6/2003 |
| WO | 2006/053437 | 5/2006 |

OTHER PUBLICATIONS

International Search Report and Written Opinin from PCT/US11/41788 dated Jan. 19, 2012.

Examination Report for New Zealand Application No. 599,921 dated Apr. 29, 2013.

Office action from Australian Application No. 2010-319339 dated Jul. 25, 2013.

Invacare Corporation, Operator and Maintenance Manual, Pronto M5I and M61 with SureStep, 80 pgs., Rev J—Oct. 2008, copyright 2008.

Invacare Corporation, User Manual, FDX Power Wheelchair Base FDX, FDX-CG, FDX-MCG, 96 pgs., Rev A—Apr. 2010, copyright 2010.

Invacare Corporation, product Catalog, copyright 2004, printed Feb. 18, 2011, 14 pgs.

Invacare Corporation, At'm (Take Along Chair), 2 page brochure, copyright 2009.

Invacare Corporation, FDX Front-Wheel Drive Power Wheelchair, 4 page brochure, copyright 2010.

Invacare Corporation, Nutron R51, 2 page brochure, copyright 2006.

Invacare Corporation, P9000 XDT, 2 page brochure, copyright 2007.

Invacare Corporation, Pronto M51, 4 page brochure, copyright 2010.

Invacare Corporation, Pronto M51 with Formula CG Seating, 2 page web printout, printed Feb. 18, 2011.

Invacare Corporation, The New TDX Family, 25 page brochure, copyright 2008.

Invacare Corporation, Storm Series, 16 page brochure, copyright 2010.

* cited by examiner

WHEELCHAIR

RELATED APPLICATIONS

This application is the U.S. national phase entry of PCT/US2010/056663, with an international filing date of 15 Nov. 2010, which claims the benefit of U.S. provisional patent application Ser. No. 61/261,359, with a filing date of 15 Nov. 2009, and U.S. patent application Ser. No. 61/314,314, with a filing date of 16 Mar. 2010, the entire disclosures of which are fully incorporated herein by reference.

FIELD OF THE INVENTION

The invention relates generally to conveyances and, more particularly, to wheelchairs for assisting in the mobility of its users.

BACKGROUND

Wheelchairs and similar conveyances are an important means of transportation for a significant portion of society. Whether manual or powered, wheelchairs provide an important degree of independence for those they assist.

SUMMARY

In one embodiment, the present invention is directed to a conveyance such as a wheelchair that includes a seat assembly and a chassis. In this embodiment, the chassis comprises a central frame member disposed substantially along the centerline of the wheelchair. The central frame member includes portions for connecting to or supporting one or more front casters, a seat assembly, one or more drive wheel assemblies, an energy source (e.g., one or more batteries), rear anti-tip wheels, and/or at least one footplate. Optional shrouding may also be supported on the central frame member or chassis. The central frame member is disposed substantially along the centerline of the wheelchair and structurally distributes of the weight of the seat assembly (and optionally the weight of the energy source) to the supporting drive wheels and casters. In this manner, a clean-looking, simple, and lightweight chassis structure is provided for a conveyance.

The present application also discloses exemplary embodiments of a seat assembly that optionally provides the appearance of a floating seat, of a battery pack housing, a foot plate assembly, a pivoting assembly for lowering the foot plate to the ground, and an armrest assembly. Wheelchairs in accordance with the present invention may include any combination or subcombination of the features disclosed by the present application.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DETAILED DESCRIPTION

As described herein, when one or more components are described as being connected, joined, affixed, coupled, attached, or otherwise interconnected, such interconnection may be direct as between the components or may be indirect such as through the use of one or more intermediary components. Also as described herein, reference to a "member,"

"component," or "portion" shall not be limited to a single structural member, component, or element but can include an assembly of components, members or elements.

Figure 1:
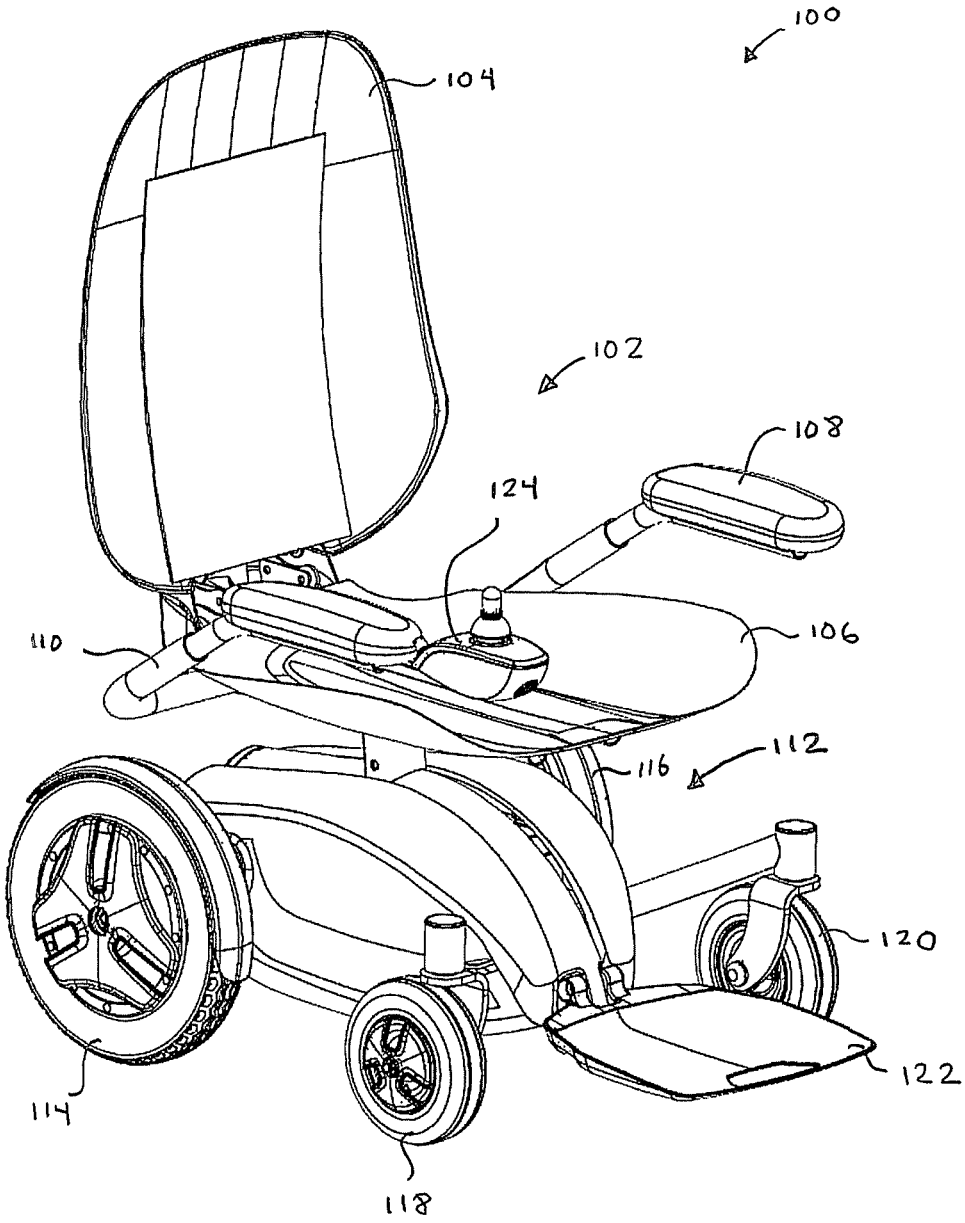
FIG. 1 is a perspective view of an exemplary embodiment of a conveyance incorporating aspects of the present invention.

Referring to FIG. 1, a conveyance such as a wheelchair 100 is illustrated. Wheelchair 100 includes a seat assembly 102 and a chassis 112. Seat assembly 102 includes a back portion 104, a seat portion 106, and armrests assemblies 108 and 110. Back portion 104 and seat portion 106 are constructed in such a manner so as to allow the angle there between to be adjusted and to also allow for folding of these components together to facilitate disassembly and transportation of wheelchair 100.

Chassis 112 further includes drive wheels 114 and 116 connected thereto for propulsion of wheelchair 100. Drive wheels 114 and 116 may be driven by a plurality of types of drive assemblies including, for example, electric motor and gear combinations or gearless brushless motors such as wheel hub motors. Casters 118 and 120 are also connected to chassis 112 for providing forward support of wheelchair 100. A footplate 122 is connected to the front portion of chassis 112 to support the feet of a user. A joystick 124 is also provided to allow a user to control the drive system of wheelchair 100.

Figure 2:
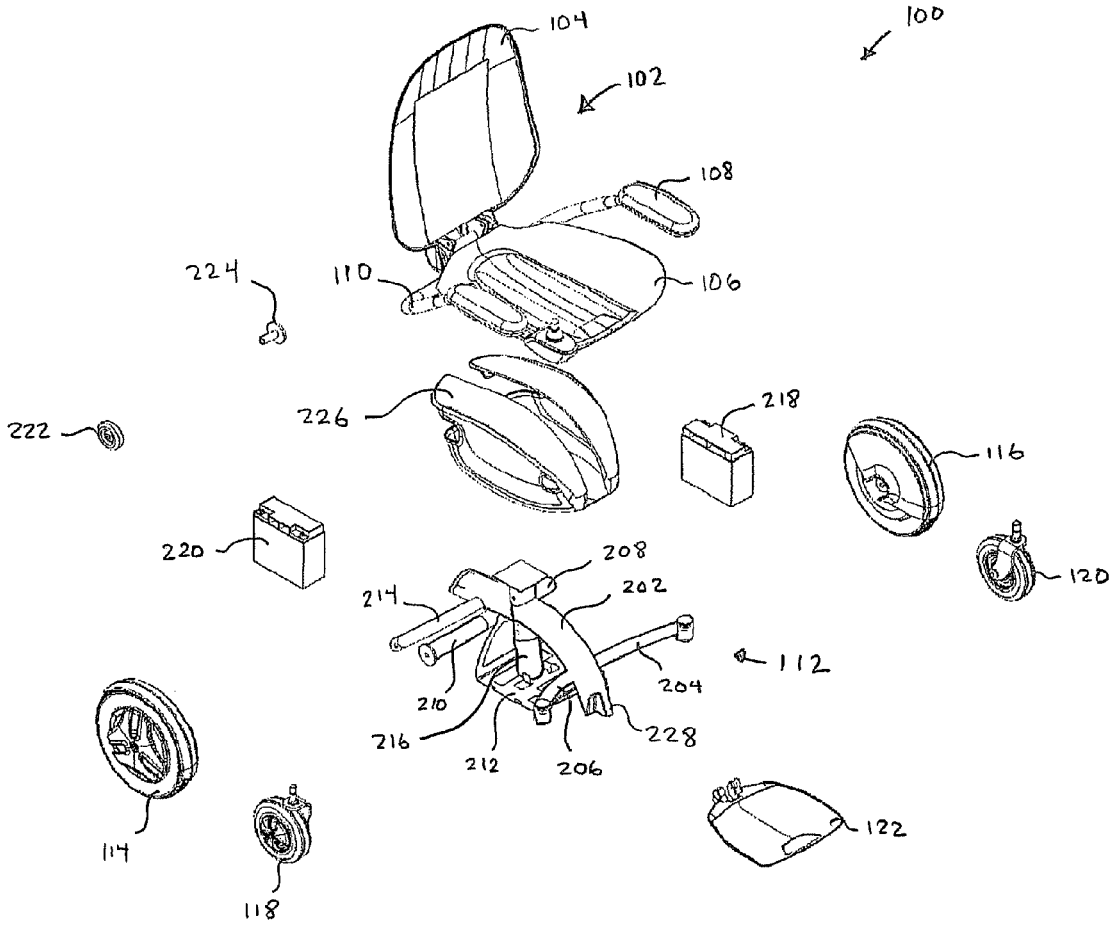
FIG. 2 is an exploded perspective view of the conveyance of FIG. 1.

Illustrated in FIG. 2 is an exploded perspective view of wheelchair 100. Chassis 112 includes several components for supporting and driving wheelchair 100 and its occupant. Chassis 112 includes a central frame member 202 disposed substantially along the centerline of wheelchair 100. Caster support members 204 and 206 are disposed proximate the forward portion of central frame member 202 and provide for mounting of casters 118 and 120. Axle support members 208 and 210 are disposed proximate an intermediate or central portion of central frame member 202 and provide for mounting of drive wheels 114 and 116. In this particular embodiment, drive wheels 114 and 116 are of a wheel hub motor design having the drive motors incorporated into the hub of the wheels. As described above, other types of drive assemblies may also be used.

Battery support member or tray 212 is also disposed proximate an intermediate or central portion of central frame member 202. Battery tray 212 supports one or more batteries 218 and 220, which are the energy source of wheelchair 100. One or more anti-tip support members 214 and 215 (shown in FIG. 6, for example) are disposed proximate a rear portion of central frame member 202 and provide for mounting of one or more anti-tip wheels or casters 222 and 224. A seat support member 216 is disposed proximate an intermediate or central portion of central frame member 202 and provides for mounting of chair assembly 102 to chassis 112.

Figure 3:
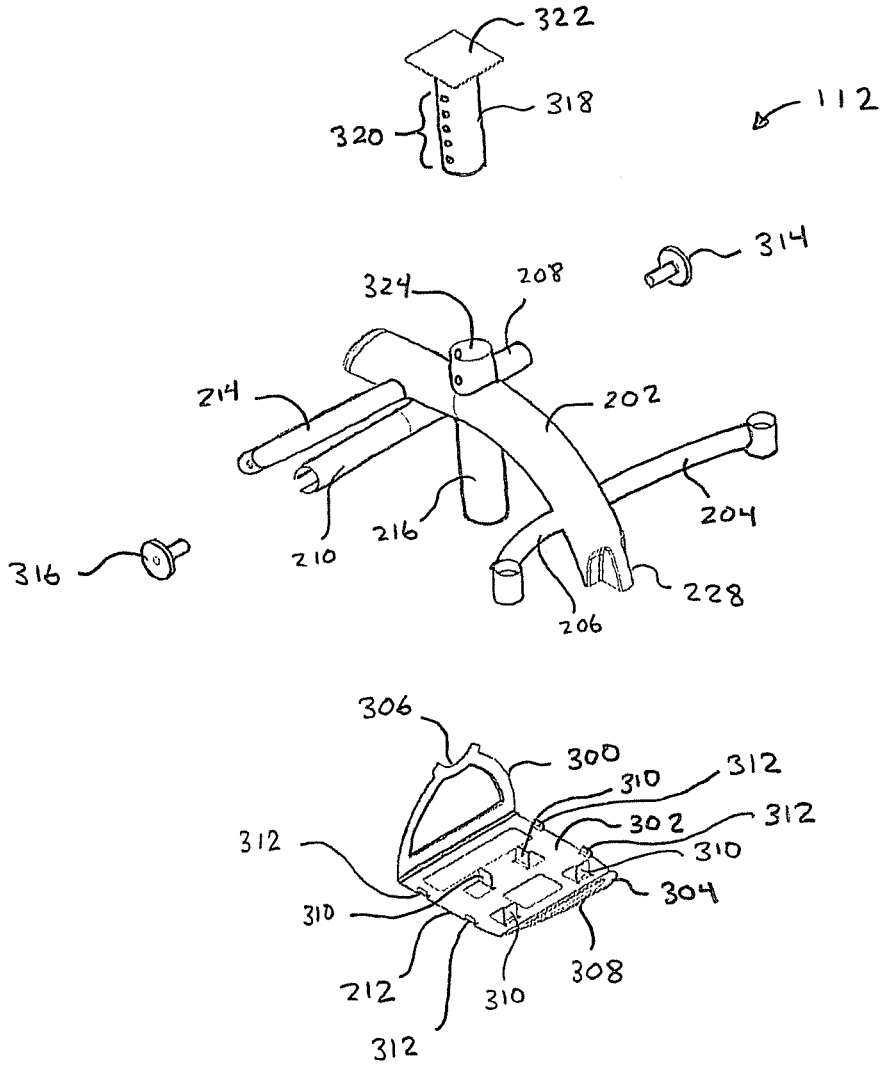
FIG. 3 is an exploded detail view of one embodiment of a chassis associated with the conveyance of FIG. 1.

Referring now to FIG. 3, an exploded perspective view of chassis 112 is shown. Battery tray 212 includes a plurality of features or components including a base portion 302 and mounting portions or brackets 300 and 304. Mounting portions 300 and 304 each include portions 306 and 308, respectively, for attaching battery tray 212 central frame member 202. Battery tray 212 can be, but does not necessarily have to be, attached to one or more bottom portions of central frame member 202. Attachment may be by any suitable means including weldments and/or fasteners.

Base portion 302 of battery tray 112 includes a plurality of inboard tabs 310 and perimeter tabs 312. Inboard tabs 310 are disposed on the inner portion of base 302 and, rise vertically therefrom. Perimeter tabs 312 are disposed proximate the perimeter of base 302 and rise vertically therefrom as well. In board and perimeter tabs 310 and 312 assist to locate and hold batteries 218 and 220 by bearing against the battery housings. Tabs 310 and 312 are formed through cut-outs in base 302 so as to thereby not add any additional weight to wheelchair 100. Alternatively, tabs 310 and 312 can be formed from components or elements separate from base 302.

Axle bushings 314 and 316 are provided for mounting the axle of drive wheels 114 and 116 to chassis 112. In the illustrated embodiment, axle bushings 314 and 316 are received within axle support members 210 and 208. When the drive wheels 114, 116 are driven by hub motors, the bushings may be omitted and the hub motors may be secured directly to the support members 208, 210. Axle bushings 314 and 316 include a large diameter rim from which a central portion thereof projects a cylindrical bushing member. A large diameter rim serves at least in part to bear against the end portion of the axle support members to facilitate proper connection there between.

Seat support member 216 is disposed on central frame member 202 and includes a receiving portion 324 having one or more apertures therein. Receiving portion 324 telescopically receives inner seat support number 318 therein for adjusting and fixing the floor-to-seat height of the wheelchair. The seat assembly is removably attached to seat mounting plate 322. The floor to seat height of the wheelchair is adjusted and fixed through the use of a plurality of apertures 320 in inner seat support member 318, which are aligned with the apertures in receiving portion 324. A suitable fastener is then used through the appropriately aligned apertures to fix or maintain them in position. The fastener may be of an easily removable type not requiring the use of tools.

Figure 4:
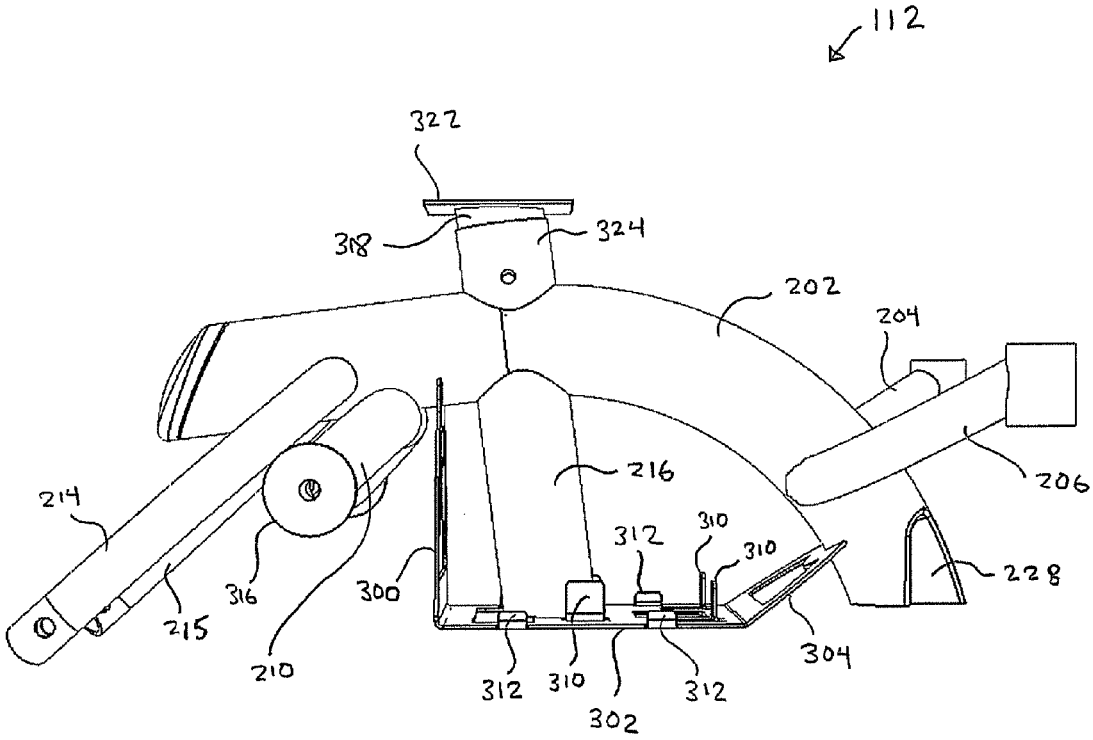
FIG. 4 is a side elevational view of one embodiment of a chassis associated with the conveyance of FIG. 1.

FIG. 4 illustrates a side elevation view of chassis 112. As shown, central frame member 202 comprises a body approximating a horizontally disposed "j" shape where the arcuate portion thereof is generally disposed in a downward direction. The arcuate portion of central frame member 202 includes sections connected to caster support members 204 and 206 and front mounting portion 304 of battery tray 212. The substantially horizontal portion of central frame member 202 includes sections connected to axle support members 208 and 210 and anti-tip support members 214 and 215. Rear mounting portion 300 of battery tray 212 is also connected or a fixed to the substantially horizontal portion of central frame member 202. Seat support member 216 is disposed at a location proximate where the substantially horizontal portion of central frame member 202 starts to become arcuate, but maybe disposed either entirely within the substantially horizontal portion or the arcuate portion. Furthermore, central frame member 202 is not limited to a horizontally disposed "j" shape as shown but may have any one of a plurality of other shapes including, for example, "j" shapes where the arcuate portion is generally disposed in an upward direction, "L" shapes where the base of the "L" shape is generally disposed downwards or upwards, "U" shapes and other shapes.

In one embodiment, central frame member 202 can be a fabricated component made of metal and/or composite material. As such, central frame member 202 can have the foot plate mounting portion 228 integrally fabricated therein. Alternatively, central frame member 202 can be fabricated from multiple components that, when jointed or fixed together, form a central fame member of the conveyance.

While axle support members 208 and 210 are shown disposed on central frame member 202 in a manner providing a rear wheel drive configuration for wheelchair 100, axle support members 208 and 210 can be disposed more forward of their current positions so as to provide a mid-wheel drive configuration or even a front wheel drive configuration. As such, axle support members 208 and 210 can be positioned on the arcuate portion of central frame member 202.

Figure 5:
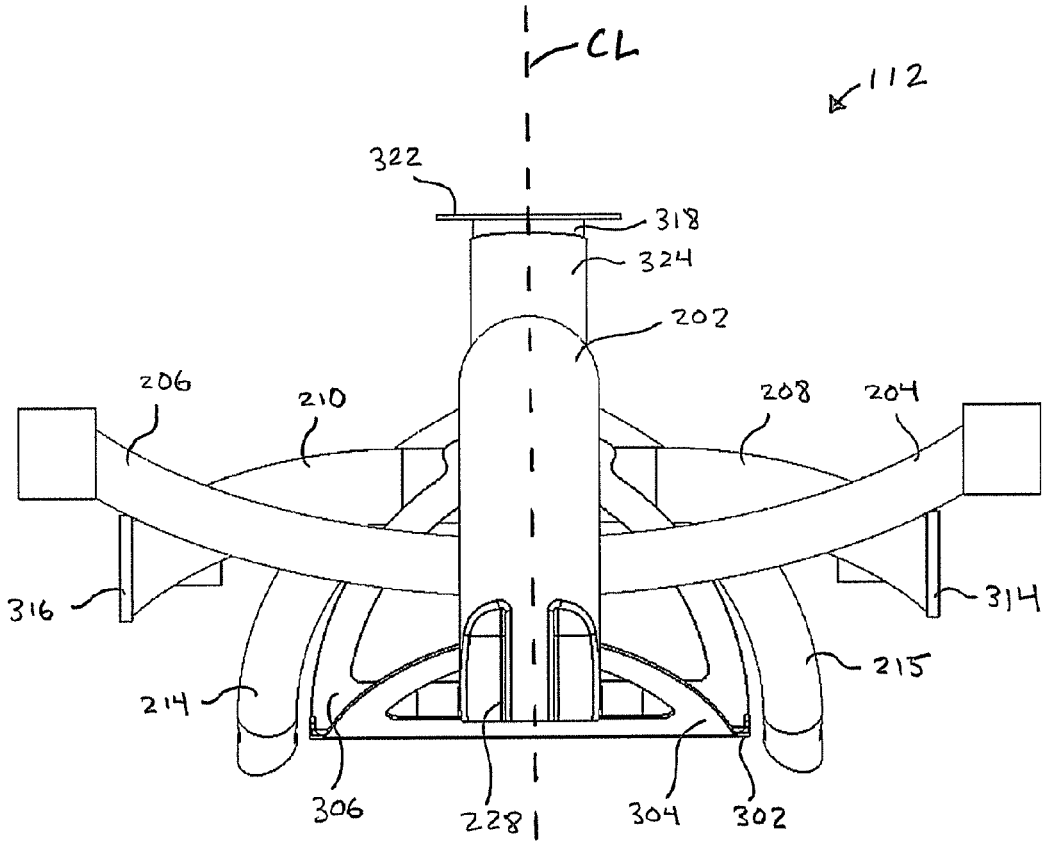
FIGS. 5 and 6 are front and rear elevational views of one embodiment of a chassis associated with the conveyance of FIG. 1.
Figure 6:
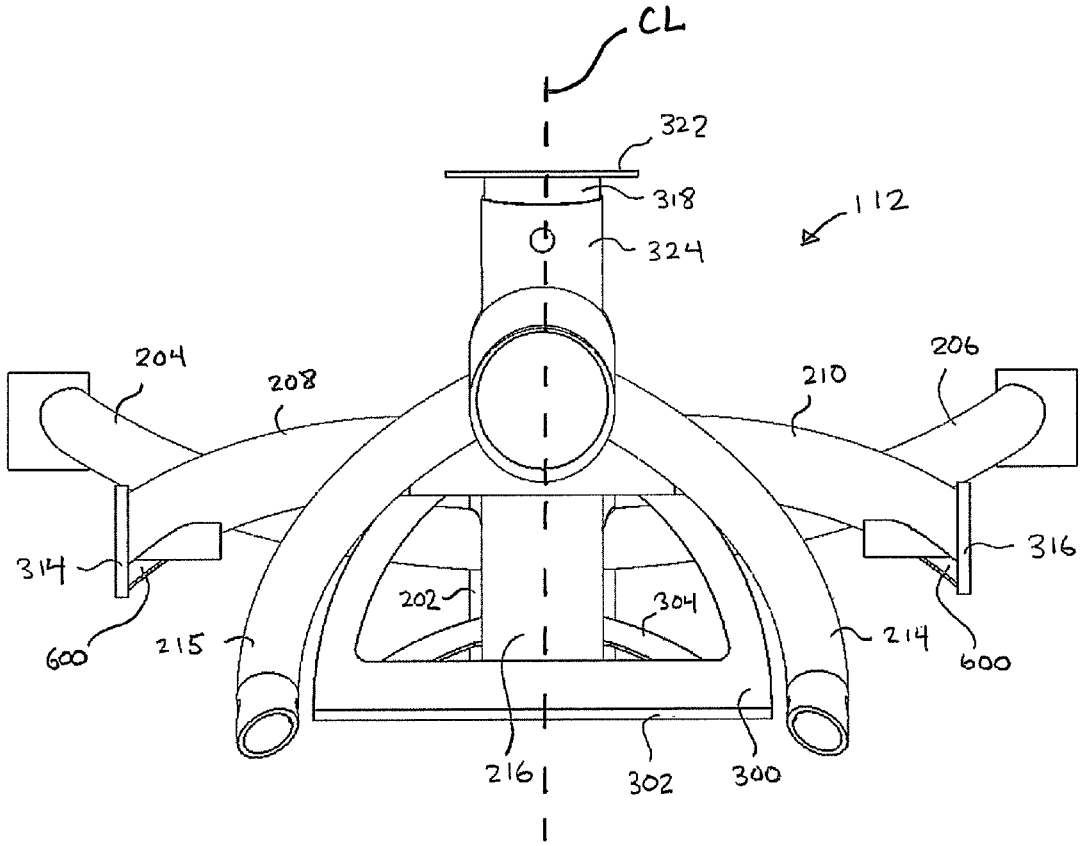

FIGS. 5 and 6 illustrate the front and rear elevation the views of chassis 112. As shown in this embodiment, central frame member 202 is disposed substantially along the centerline CL of chassis 112. As such, central frame member 202 structurally distributes the weight associated with chair assembly 102 (FIG. 1) and energy source (batteries 218 and 220; FIG. 2) to the drive wheels and casters through axle support members 208 and 210 and caster support members 204 and 206, respectively.

In the embodiment shown, the geometry of caster support members 204 and 206 is illustrated in FIGS. 4 and 5. Each caster support member emanates from the lower portion (but this does not have to be the case) of central frame member 202 in a progressively upward arcuate manner and extending in the forward direction of the chassis. Collectively, the caster support members 204 and 206 form a "U" or "V" shape that extends upwardly and away from central frame member 202. Other geometric configurations for caster support members 204 and 206 include members having downwardly arcuate portions extending from central frame member 202 and members having both upwardly and downwardly arcuate portions extending from central frame member 202. Other geometries are also possible.

FIGS. 4, 5 and 6 also illustrate the geometry of axle support members 208 and 210 in this embodiment. Axle support members 208 and 210 emanate from a lower portion of central frame member 202 and extend downwardly and away therefrom. In this particular embodiment, axle support members 208 and 210 extend in a rearward direction of the chassis. These members also collectively form a "U" or "V" shape extending away from central frame member 202. Furthermore, as shown in FIG. 6, axle support members 208 and 210 include slots 600 in their bodies for accommodating axel bushings 314 and 316. Slots 600 are disposed proximate to a distal portion of axle support members 208 and 210. Slots 600 may or may not be required depending on the size or diameter of axle support members 208 and 210 and whether the drive wheels 114, 116 are driven by hub motors (hub motors may be secured directly to the axle support members 108, 210 and the slots 600 may be omitted). Other geometric configurations for axle support members 208 and 210 include members having upwardly arcuate portions extending from central frame member 202 and members having both upwardly and downwardly arcuate portions extending from central frame member 202. Other geometries are also possible.

FIGS. 4, 5, and 6 also illustrate the geometry of anti-tip support members 214 and 215. In this embodiment, anti-tip support members 214 and 215 emanate from a rearward portion of central frame member 202 and extend downward and away therefrom. Apertures are located in the distal ends of anti-tip support members 214 and 215 for attachment of the coupling of anti-tip wheels or casters. As shown, the distal end of anti-tip support members 214 and 215 projects beyond the rearward most portion of central frame member 202. However, this need not be the case. Collectively, anti-tip support members 214 and 215 form a generally inverted "V" or "U" shape having arcuate segments, though linear and a combination of arcuate and linear segments may also be used in the construction of the shapes.

Figure 7:
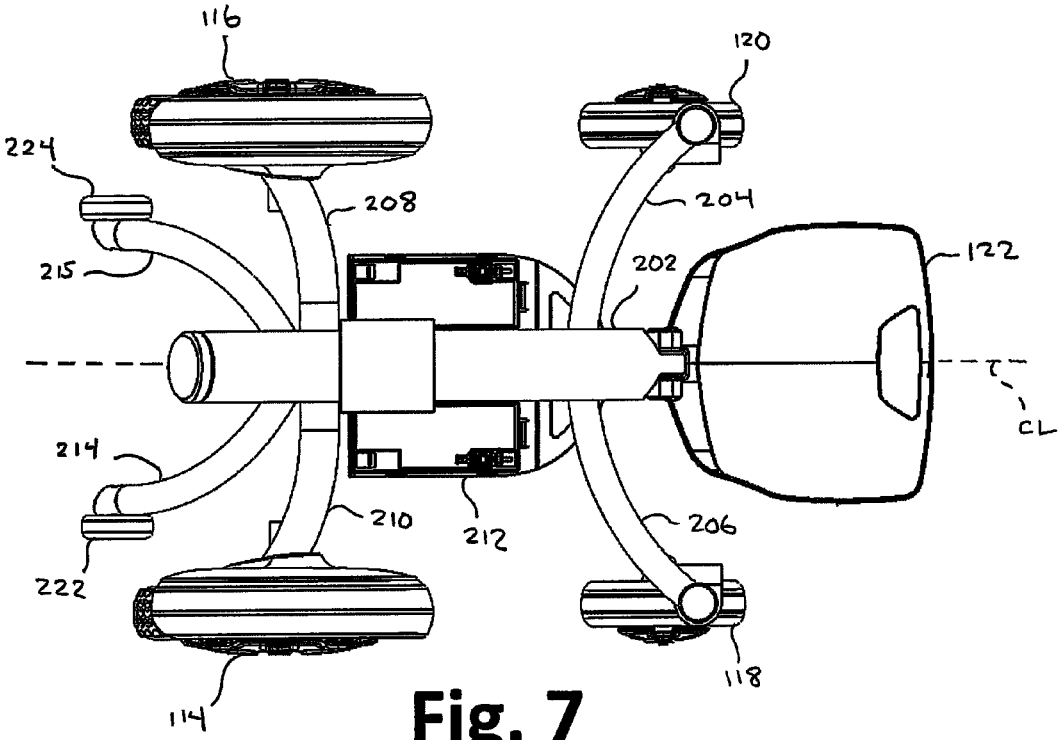
FIGS. 7 and 8 are top and bottom plan views of one embodiment of a chassis associated with the conveyance of FIG. 1.
Figure 8:
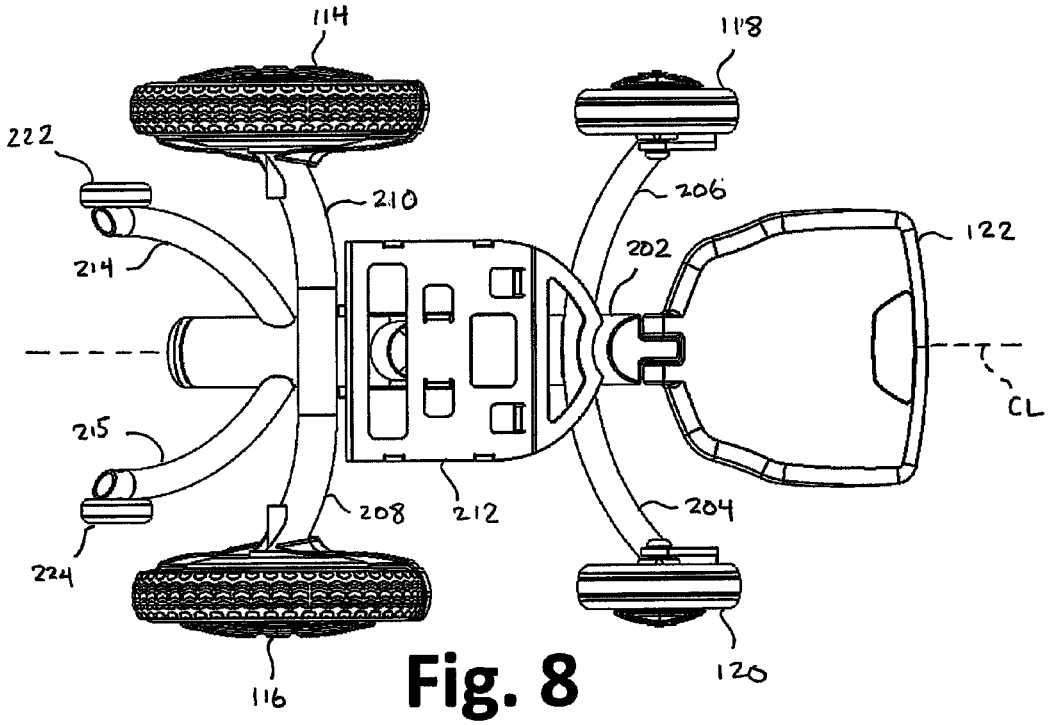

FIGS. 7 and 8 illustrate top and bottom views of chassis 112. As shown therein, central frame member 202 is disposed substantially along centerline CL. Also, caster support members 204 and 206, battery tray 212, axle support members 208 and 210 and anti-tip support members 214 and 215 are all also symmetrically disposed about centerline CL. As such, in this embodiment, each of these members possesses a geometry on one side of the centerline CL that is a mirror image of the geometry on the other side of the centerline CL. Also, central frame member 202 is a larger size or diameter than the caster support members 204 and 206, axle support members 208 and 210, and anti-tip support members 214 and 215. In other embodiments, these members can be all of the same size or different sizes so long as the proper load-bearing requirements are met.

Figure 9:
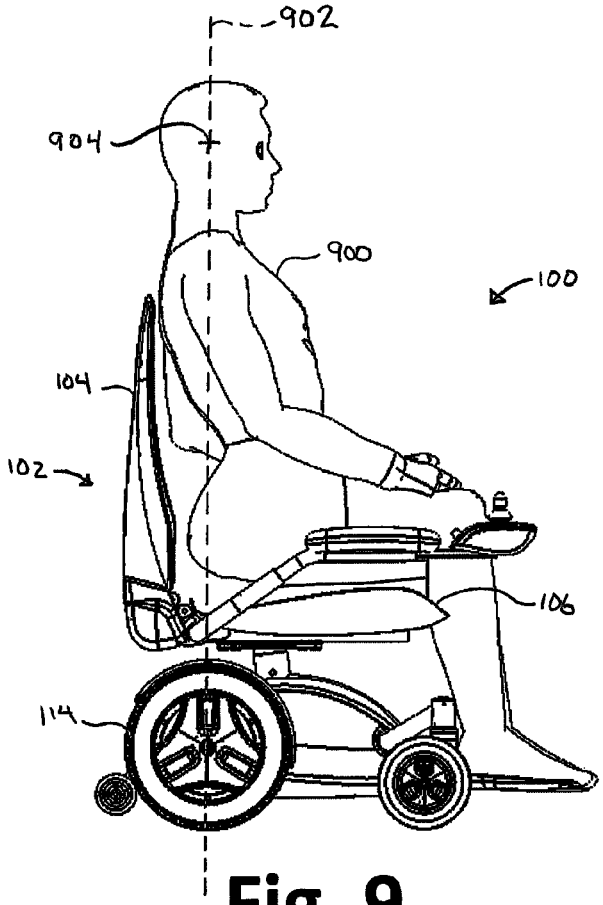
FIGS. 9 and 10 are side elevational and top plan views of one embodiment of a conveyance having an occupant seated therein.
Figure 10:
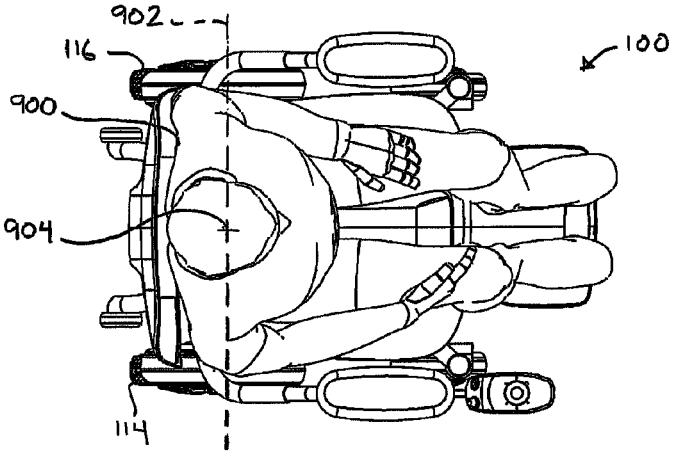

Referring now to FIGS. 9 and 10, side elevational and top plan views of wheelchair 100 are shown having an occupant 900 seated therein. The position of occupant 900 can be adjusted by, for example, lateral and/or angular movement of back 104 relative to seat 106, or lateral movement of seat 106 relative chassis 112. In one embodiment, the position of occupant 900 is configured such that the occupant's center of perception 904 is substantially aligned with a vertical plane 902 extending between or through the axles of drive wheels 114 and 116. In other embodiments, the occupant's center of perception 904 can be placed proximate to vertical plane 902, either slightly forward or rearward thereof.

Referring back to FIG. 3, wheelchair 100 may in one embodiment include a transportable configuration. In this embodiment, wheelchair 100 may be disassembled into subassemblies or components that are easily individually transportable in, for example, an automobile. As shown in FIG. 2, wheelchair 100 may be disassembled by removing chair assembly 102, drive wheels 114 and 116, and batteries 218 and 220 from chassis 112. Still further, other components can be additionally or alternatively be removable from chassis 112 including footplate 122 and casters 118 and 120.

In this manner, these components can be easily stored for transportation and quick re-assembly without the use of tools. To facilitate disassembly and assembly, wheelchair 100 can include any number of mechanisms including pluggable terminals for batteries 218 and 220, and quick release or spring-loaded pins for the drive wheels 114 and 116 and chair assembly 102. Also, shroud 226 can include one or more covers capable of being opened and closed or removed and re-attached in order to allow removal and insertion of batteries 218 and 220.

Configured as such, a clean-looking, simple, and lightweight chassis structure is provided for a conveyance. The chassis 112 may be configured to be rear wheel drive, mid-wheel drive, or front wheel drive. The rear anti-tip wheels 222 and 224 may be positioned on the ground or off the ground. Similarly, the front casters 118 and 120 may be positioned on the ground or off the ground. Furthermore, one or more suspension devices or assemblies may be added to the mounting of caster support members 204 and 206, axle support members 208 and 210, and/or anti-tip support members 214 and 216. The one or more suspension devices or assemblies can take the form of springs, spring/shock absorbers, pivoting assemblies, struts, pneumatic piston/cylinder assemblies, four-bar linkage assemblies, and combinations of the foregoing.

Figure 11A:
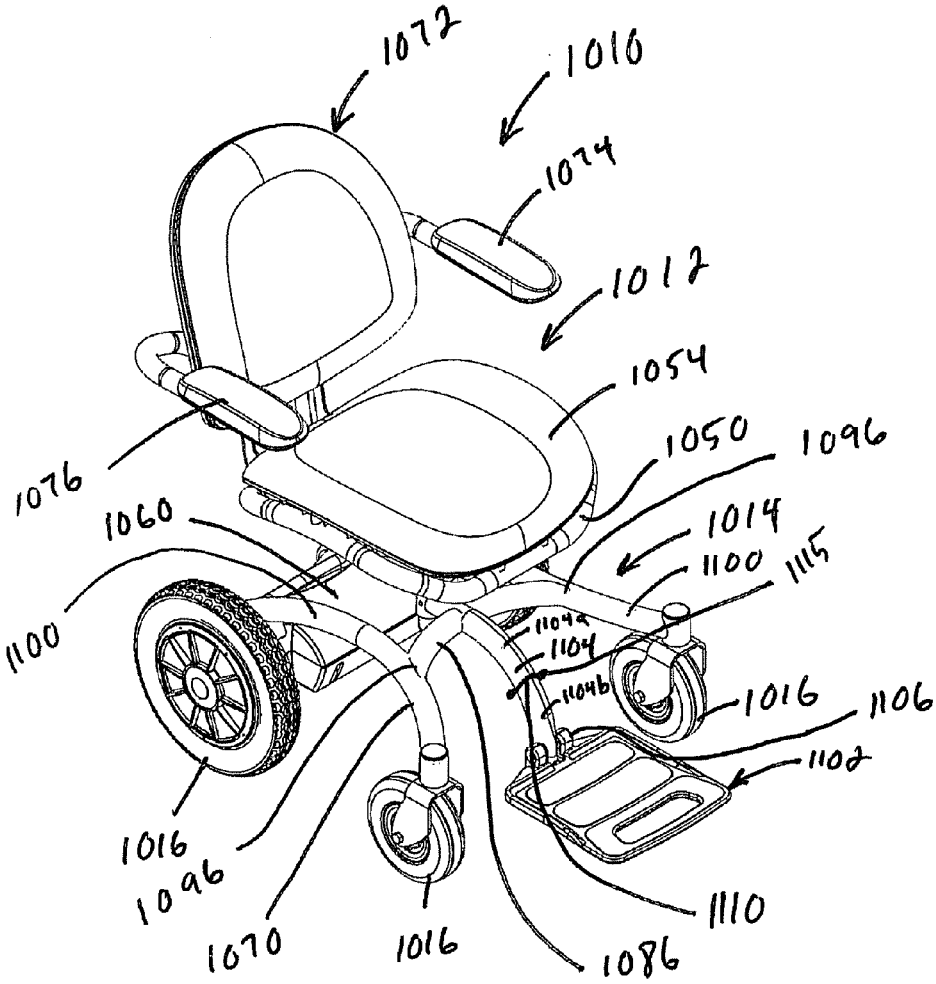
FIG. 11A is an exploded perspective view of another exemplary embodiment of a conveyance incorporating aspects of the present invention.
Figure 11B:
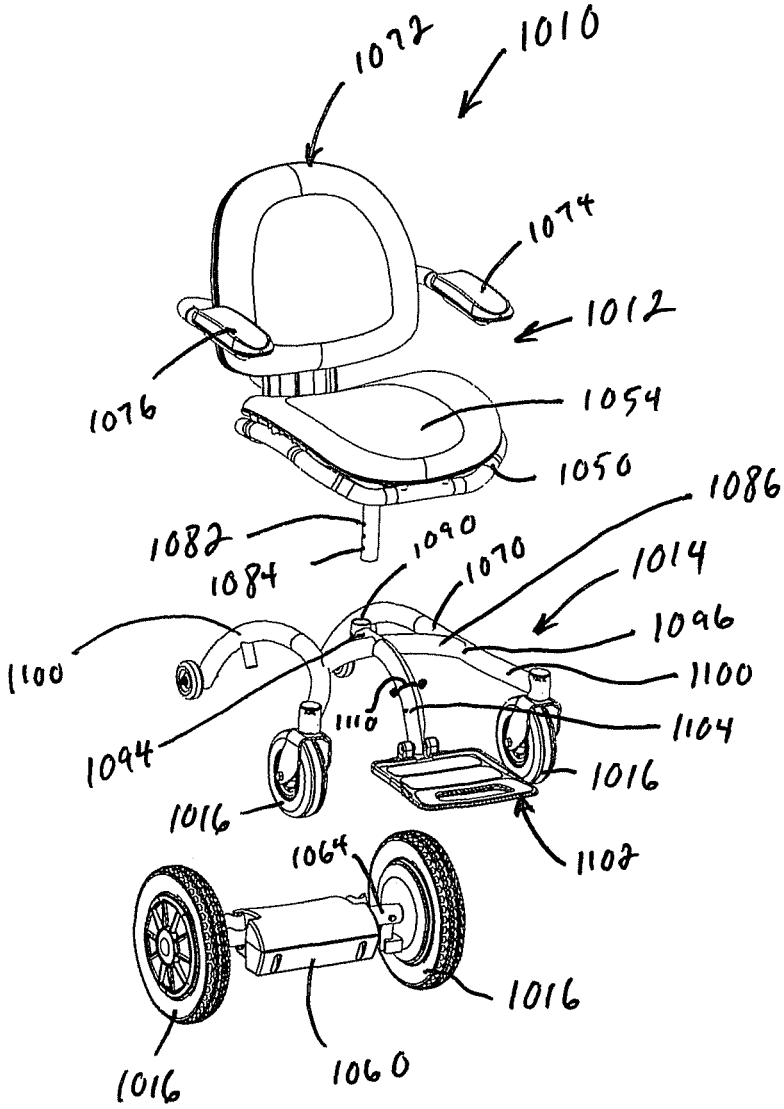
FIG. 11B is an exploded perspective view of the conveyance of FIG. 11A.
Figure 11C:
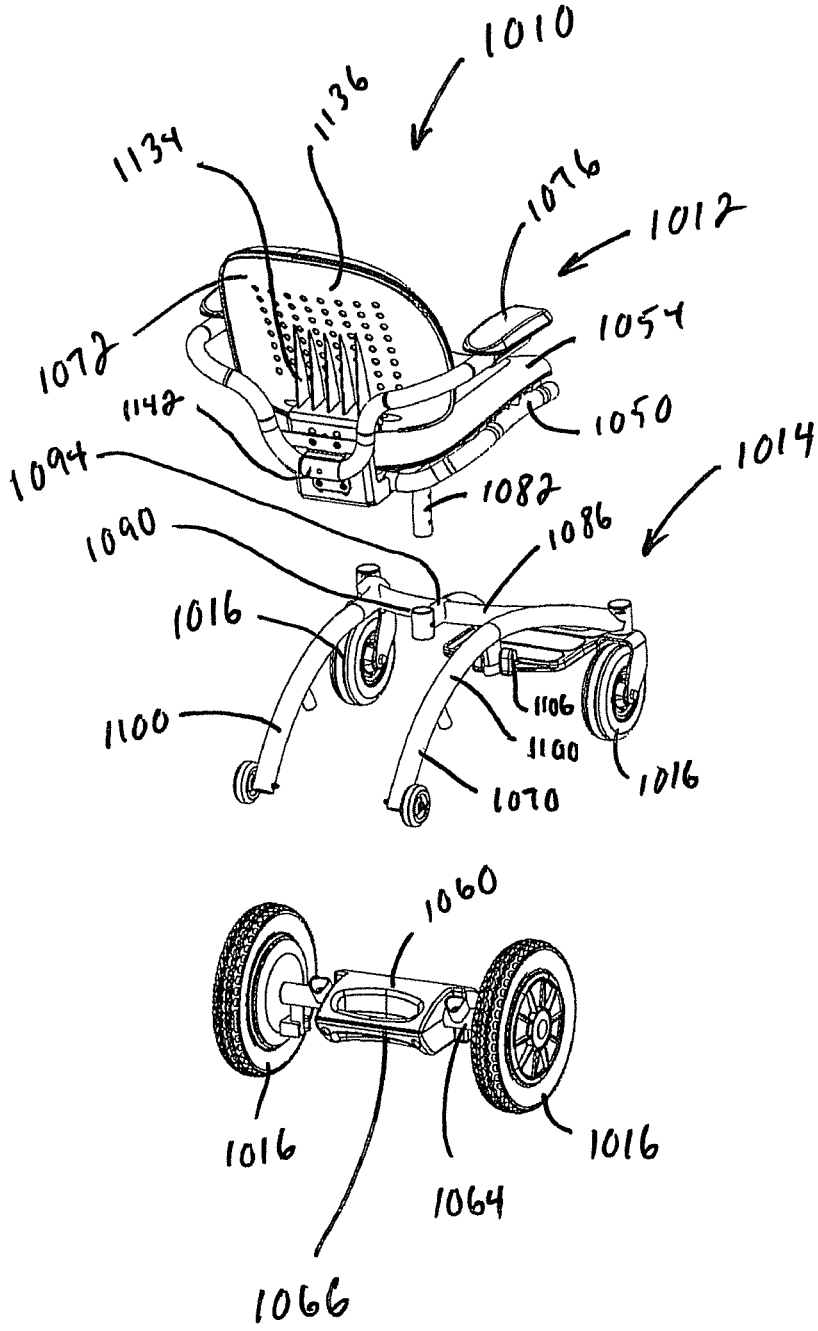
FIG. 11C is another exploded perspective view of the conveyance of FIG. 11A.

FIG. 11A illustrates another embodiment of a wheelchair 1010. The wheelchair 1010 includes a seat section 1012 and a base section 1014. Four wheels 1016 are supported on the base section 1014. As discussed below, the seat section 1012 and the base section 1014 include tubular components that provide sturdiness and offer a sleek, uncluttered design.

Seat Frame

Figure 12:
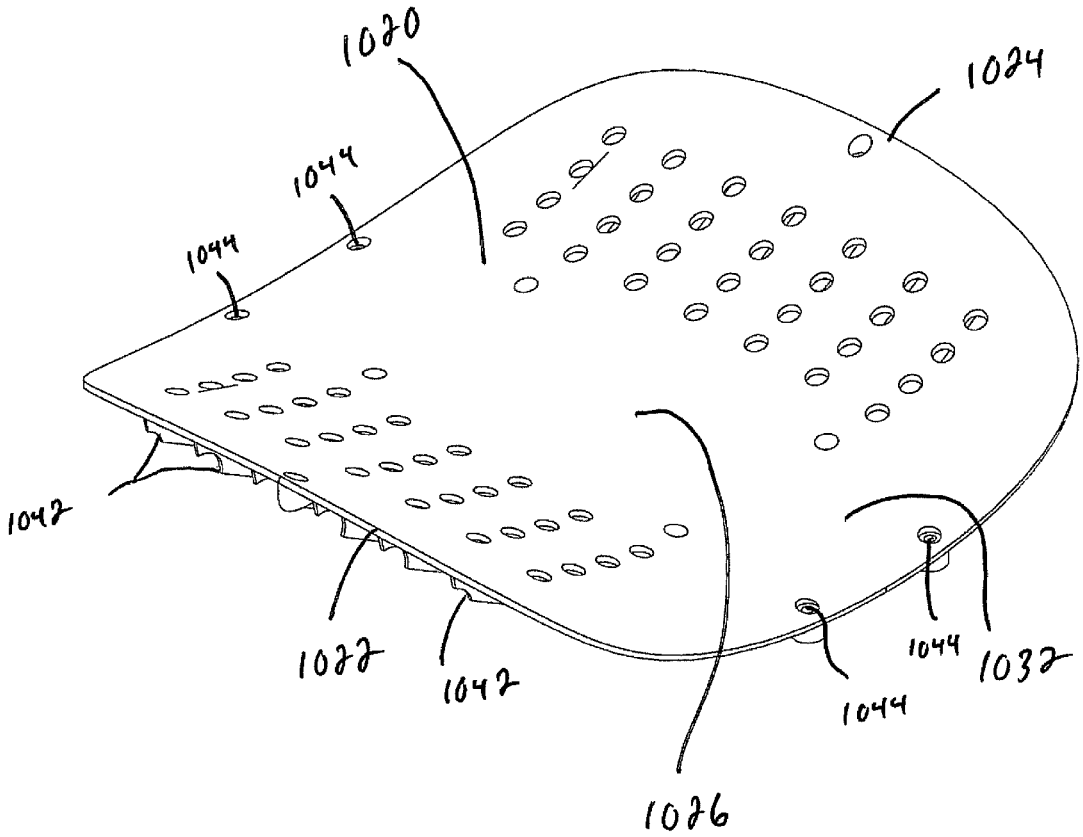
FIG. 12 is a top perspective view of a seat platform of the conveyance illustrated by FIG. 11A.
Figure 13:
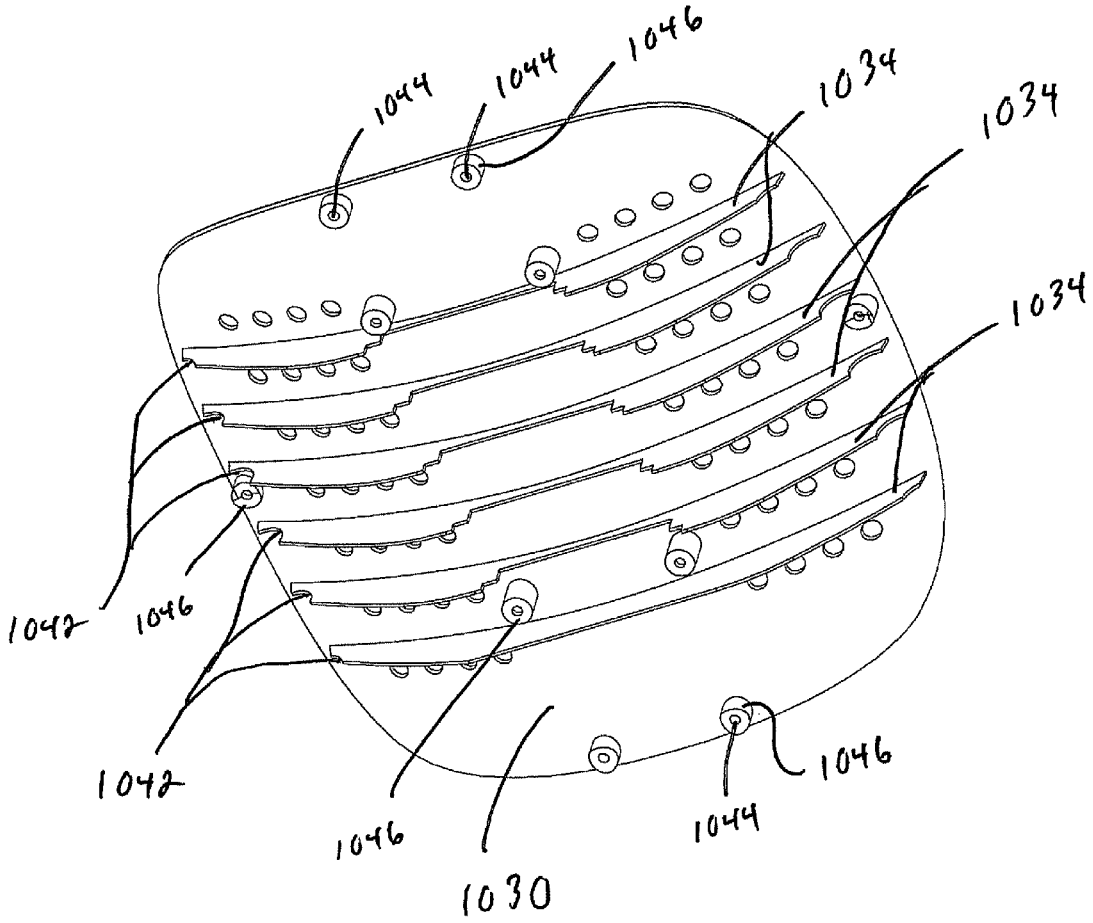
FIG. 13 is a bottom perspective view of a seat platform of the conveyance illustrated by FIG. 11A.

With reference to FIG. 12, the wheelchair seat section 1012 includes a curved seat platform 1020 having a left edge 1022, a right edge 1024, and a central portion 1026. The central portion 1026 is between the left and right edges 1022, 1024, respectively. With reference to FIGS. 12 and 13, the seat platform 1020 also includes a first (e.g., bottom) face 1030 and a second (e.g., top) face 1032. The first and second faces 1030, 1032, respectively, of the platform 1020 are curved so both the left edge 1022 and the right edge 1024 of the platform 1020 are relatively higher than the central portion 1026. In one embodiment, the first face 1030 is convex and the second face 1032 is concave.

The first face 1030 includes a plurality of support ridges 1034 extending between the left edge 1022 and the right edge 1024. In one embodiment, the support ridges 1034 are substantially parallel to each other. At least one of the ridges 1034 includes a contour.

A plurality of connection cavities 1044 are included on the first face 1030 of the seat platform 1020. The connection cavities 1044 are illustrated as passing through to the second face 1032. In one embodiment, at least one of the connection cavities includes an extender 1046 that extends away from the first face 1030.

Figure 14A:
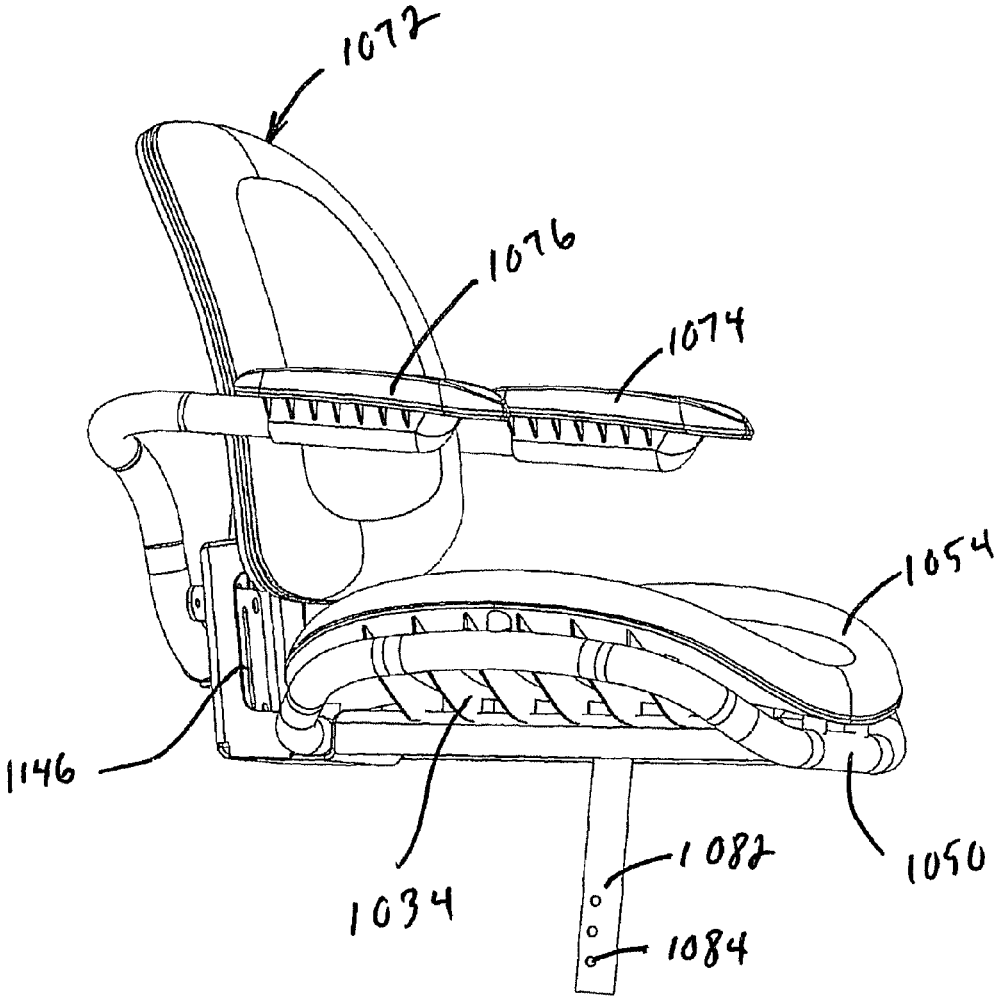
FIG. 14A is a perspective view of a seat section of the conveyance illustrated by FIG. 11A.
Figure 14B:
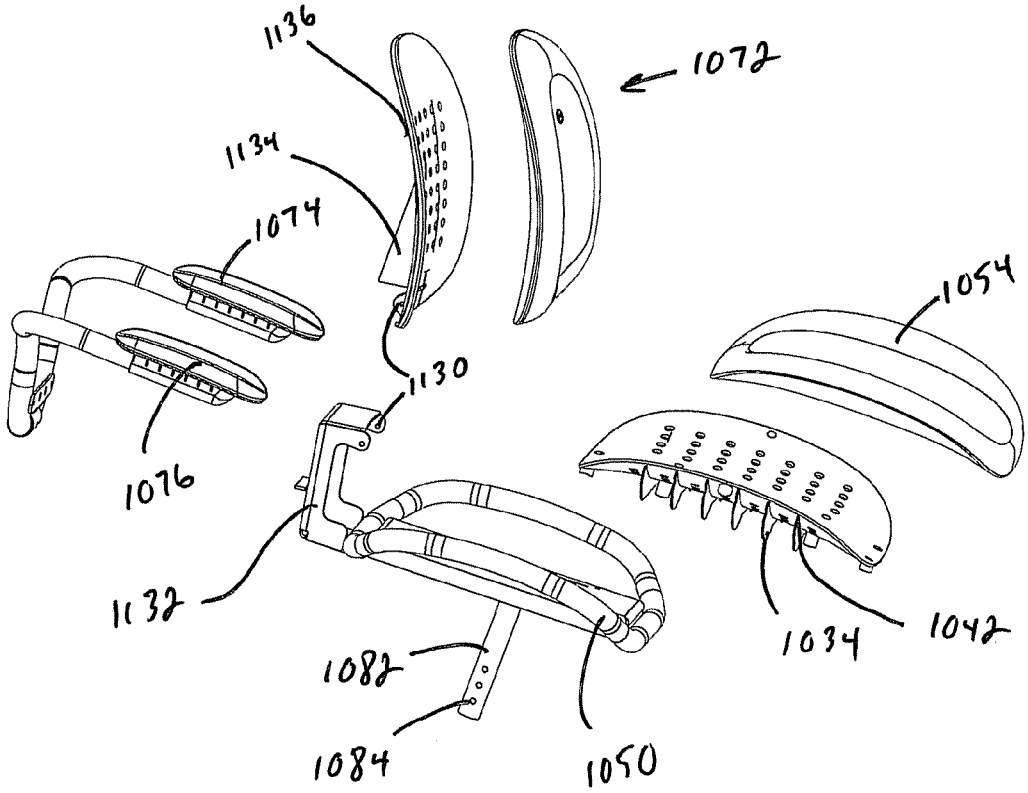
FIG. 14B is an exploded perspective view of a seat section illustrated by FIG. 14A.

With reference to FIGS. 14A and 14B, a seat frame 1050 is positioned below the seat platform 1020. In one embodiment, the seat frame 1050 is of a rounded, tubular design. The seat frame includes orifices (not shown). When it is desired to secure the seat platform 1020 to the seat frame 1050, the extenders 1046 and the connection cavities 1044 of the seat platform 1020 are aligned with the orifices of the seat frame 1050. Connecting means (e.g., bolts or other fasteners) are passed through the connection cavities 1044 of the seat platform 1020 and, in one embodiment, are threadedly secured in the orifices of the seat frame 1050.

Referrals to FIG. 13, contours 1042 in the support ridges 1034 substantially follow a shape of the curved, tubular seat frame 1050. The extenders 1046 of the connection cavities 1044 in conjunction with the contours 1042 of the support ridges 1034 act to maintain a space between the tubular seat frame 1050 and the first face 1030 of the seat platform 1020. In the illustrated embodiment, the tubular seat frame 1050 substantially follows a contour of the curved seat platform 1020 along an outer periphery of the first face 1030. In other words, the tubular seat frame 1050 acts to cradle the seat platform 1020.

Figure 15:
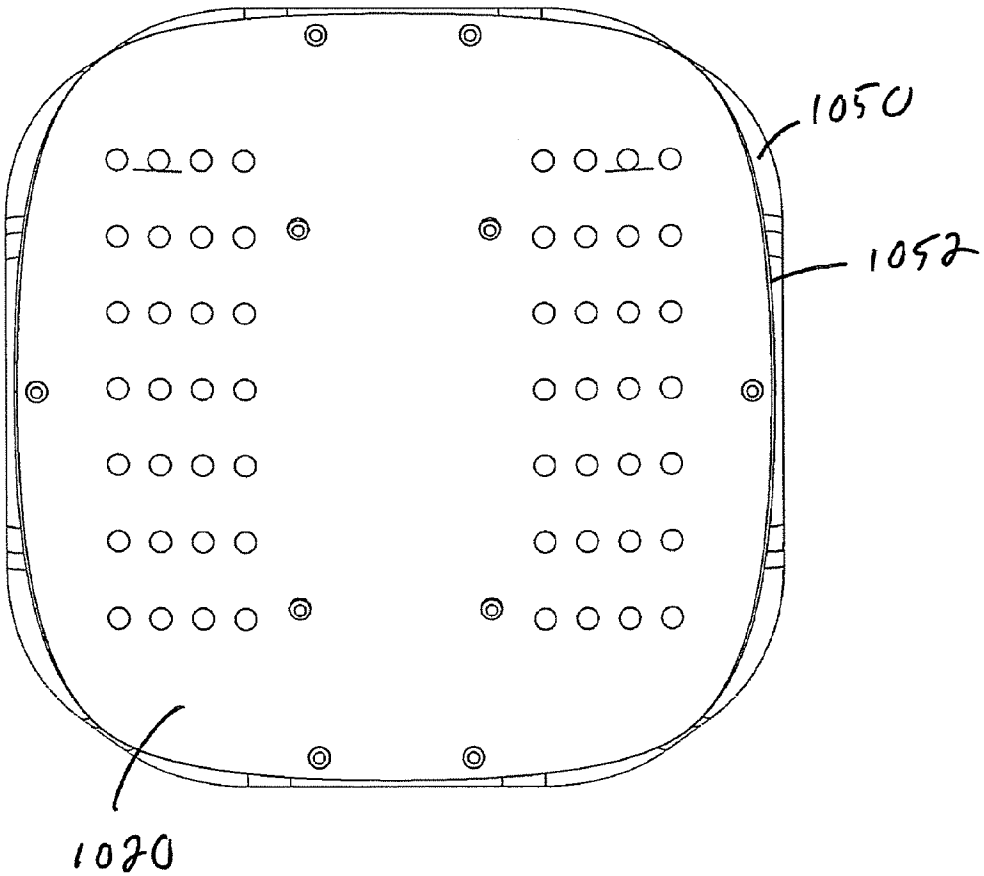
FIG. 15 is a top view of a seat platform of a seat platform on a seat platform of the conveyance illustrated by FIG. 11A.
Figure 16A:
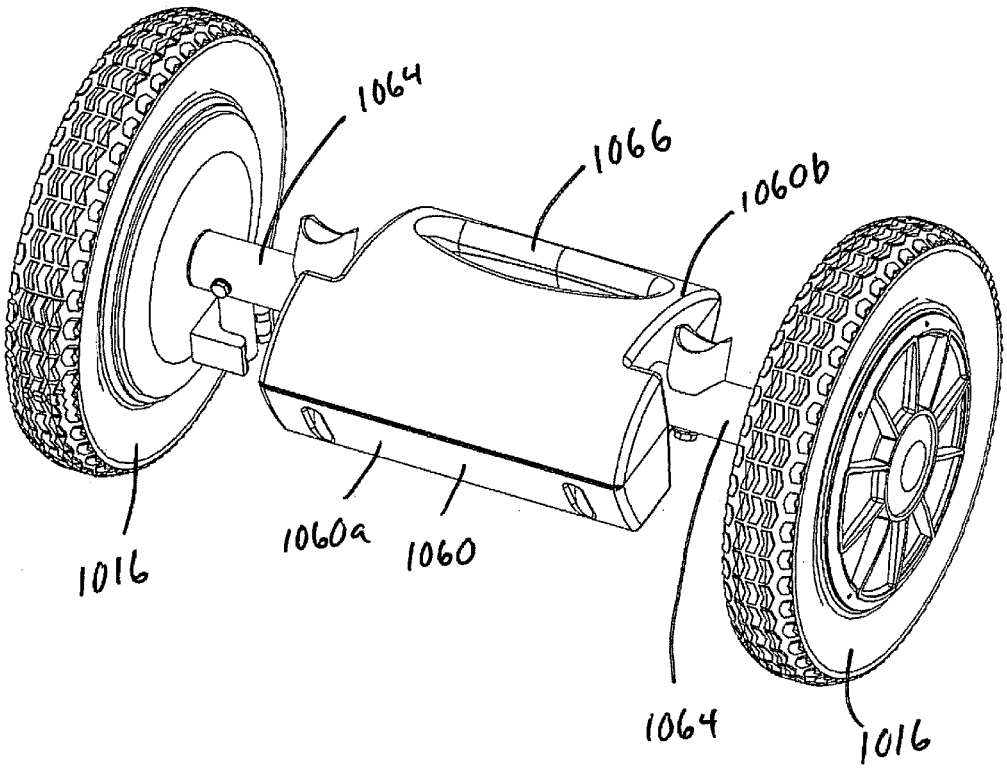
FIG. 16A is a perspective view of a battery housing and hub motor assembly of the conveyance of FIG. 11A.
Figure 16B:
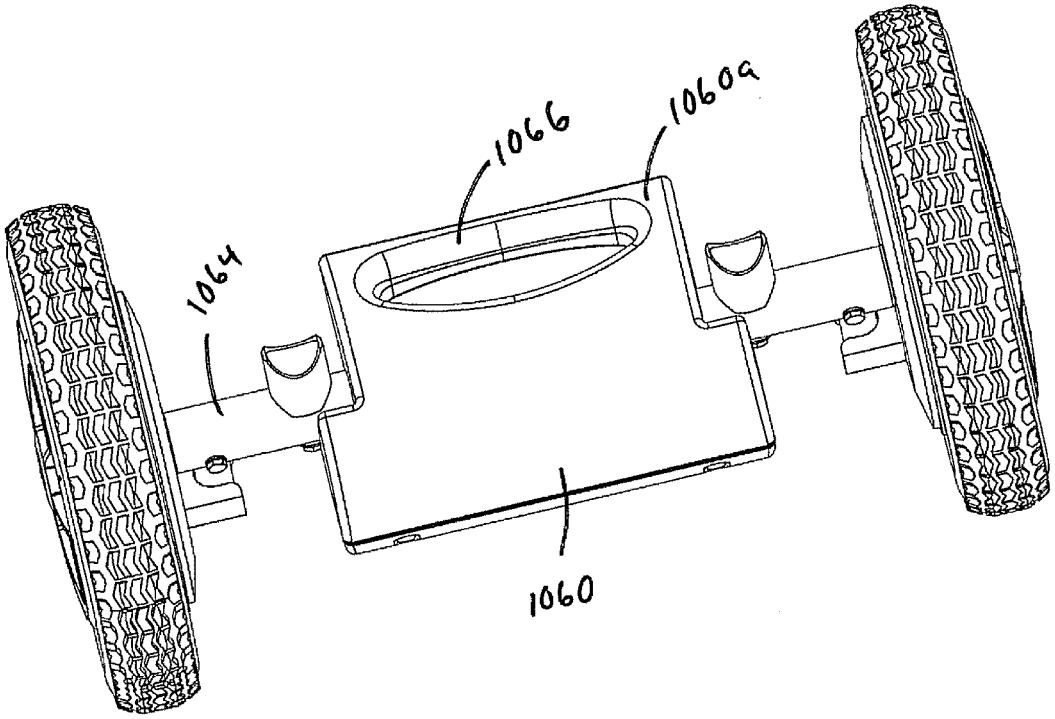
FIG. 16B is a second perspective view of the battery housing and hub motor assembly of FIG. 16A.
Figure 16C:
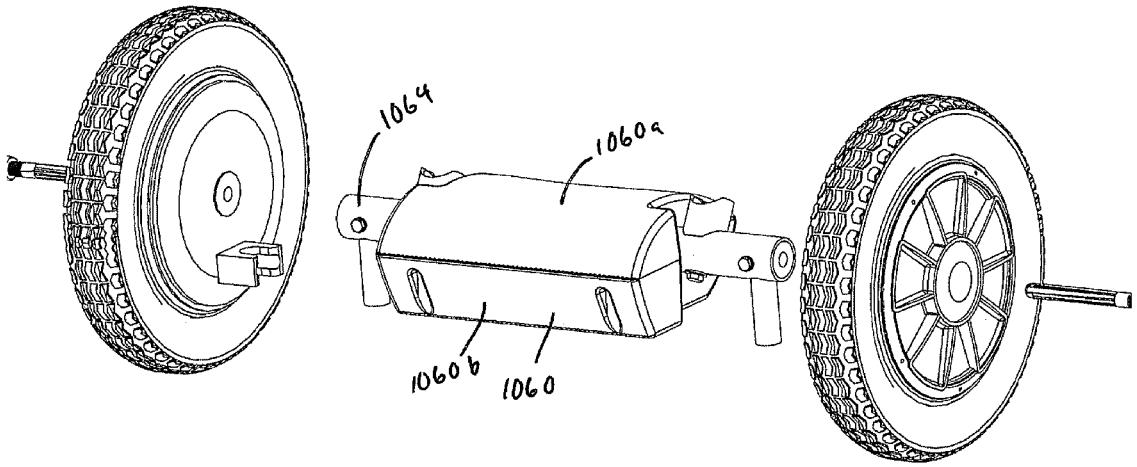
FIG. 16C is an exploded perspective view of the battery housing and hub motor assembly of FIG. 16A.
Figure 16D:
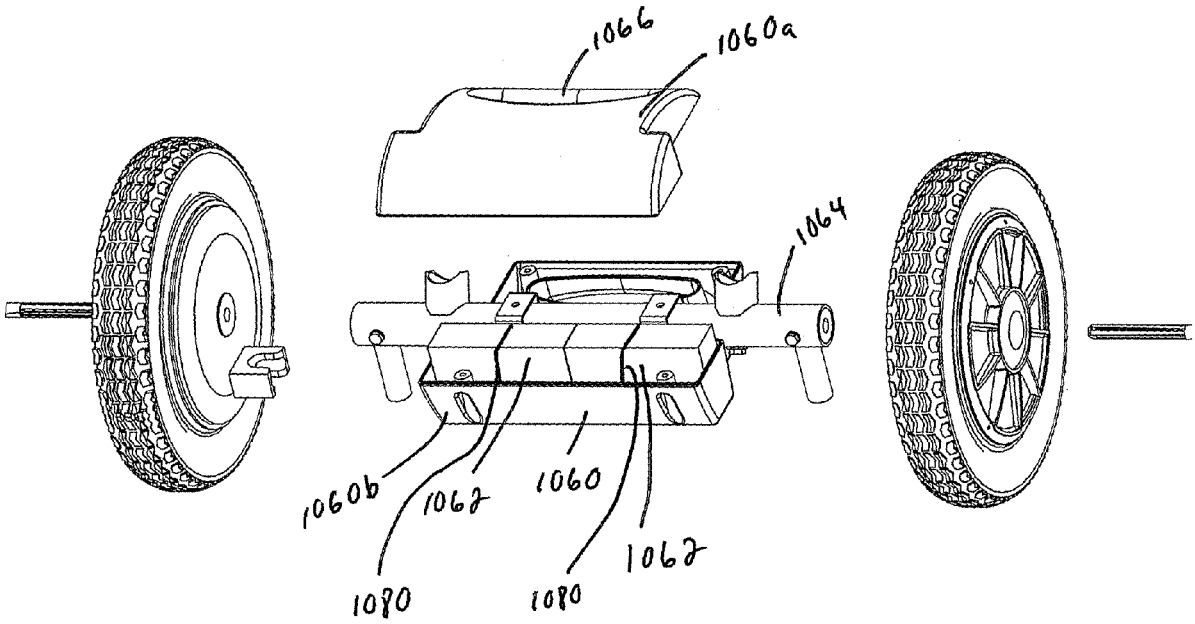
FIG. 16D is another exploded perspective view of the battery housing and hub motor assembly of FIG. 16A.
Figure 17:
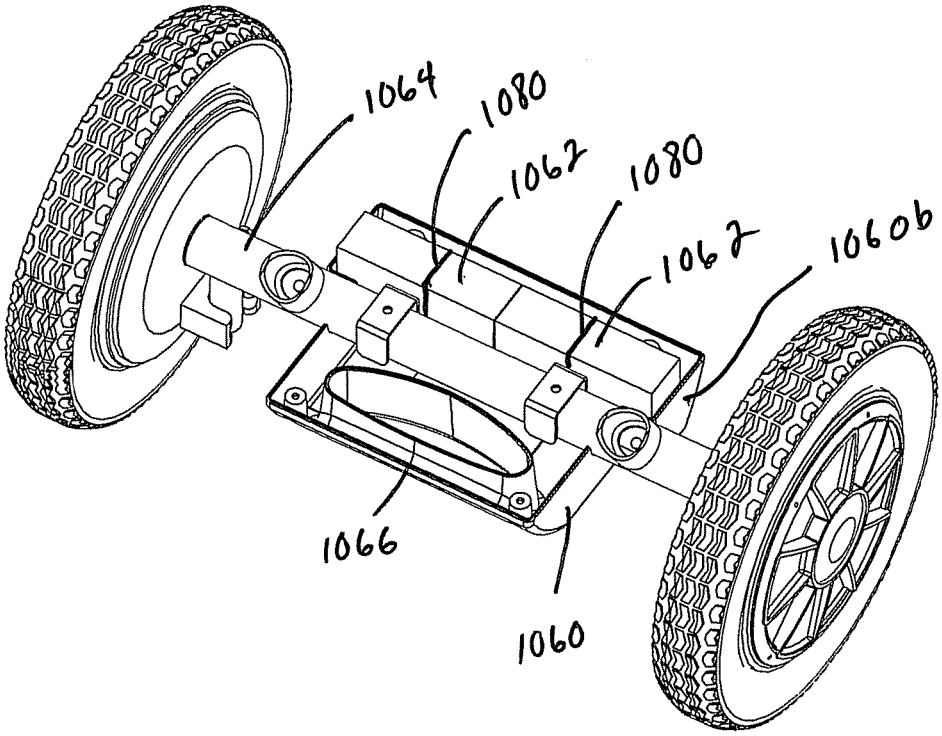
FIG. 17 illustrates the inside of the battery housing of FIG. 16A in accordance with one embodiment of the present invention.

With reference to FIG. 15, at least a portion of the seat frame 1050 partially extends beyond an outside edge 1052 of the seat platform 1020. In the embodiment illustrated in FIG. 15, the seat frame 1050 partially extends beyond the outside edge 1052 around the entire seat platform 1020. In this manner, the frame 1050 provides support around the entire outside edge 1052 of the seat platform 1020 and provides a cradle for the seat platform 1020.

With reference again to FIG. 11A, a cushion 1054, having a face curved to substantially match the curve of a second face 1032 (see FIG. 14B) of the seat platform 1020, is attached to the second face.

Battery Pack Housing

With reference to FIGS. 16A-16D and 17, a battery pack housing 1060 and at least one battery 1062 (FIG. 16D) are secured to an axle 1064 (e.g., a rear axle or rear cross member) of the wheelchair. The battery pack housing 1060 includes an integrated handle 1066. It is contemplated that the battery pack housing 1060 and integrated handle 1066 are designed to support the weight of a lower portion of the wheelchair. For example, if it is desired to disassemble the wheelchair for transport within an automobile, it is contemplated that the wheelchair may be separated into at least two (2) sections (i.e., the seat section 1012 and the base section 1014 (see FIG. 11B)). With reference to FIGS. 11A-11C and 16A-16D, the base section 1014 of the wheelchair 1010 may include the lower portion of the wheelchair (e.g., a lower frame portion 1070, the wheels 1016, the battery pack housing 1060, and the battery 1062). The seat section 1012 of the wheelchair 1010 may include an upper portion of the wheelchair (e.g., the seat platform 1020, the seat frame 1050, a seat back 1072, and left and right armrests 1074, 1076, respectively). Since the battery pack housing 1060 and integrated handle 1062 are designed to support the weight of the lower portion of the wheelchair 1010, the base section 1014 may be lifted (and placed in an automobile) by simply grasping the integrated handle 1062.

If the battery pack housing 1060 and the integrated handle 1062 are capable of supporting the weight of the base section 1014 of the wheelchair 1010, the wheelchair 1010 may be disassembled into fewer pieces for transport, for example, in an automobile. More specifically, if the battery pack housing 1060 and integrated handle 1062 are able to support the weight of the entire base section 1014 of the wheelchair 1010 (including the battery 1062), the battery pack housing 1060 and the battery 1062 are not required to be disassembled when it is desired to place the wheelchair 1010 in an automobile. Such a design results in easier and quicker disassembly and reassembly of the wheelchair 1010.

Figure 18:
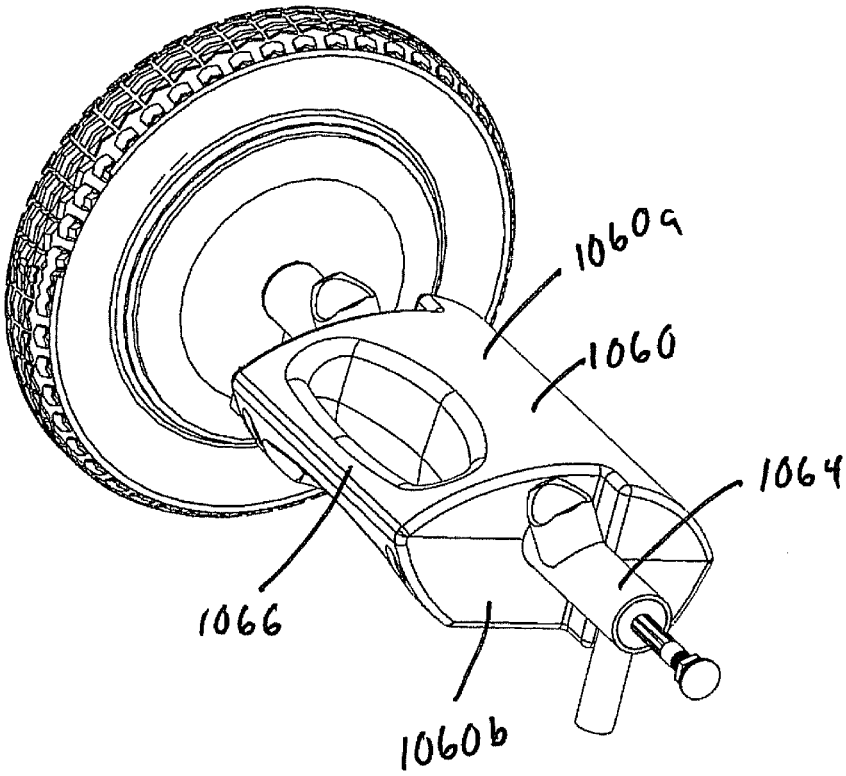
FIG. 18 is another view of the battery housing of the conveyance of FIG. 11A.

With reference to FIG. 18, the battery pack housing 1060 includes an upper portion 1060*a* and a lower portion 1060*b*. The upper and lower portions 1060*a*, 1060*b*, respectively, of the battery pack housing 1060 surround (or "hug") the rear axle 1064. The upper and lower portions 1060*a*, 1060*b* of the battery pack housing 1060 completely encases the battery for protection. Attaching the battery pack housing 1060 around the rear axle 1064 provides support when lifting the base section 1014 (see FIG. 16D) of the wheelchair by the integrated handle 1062 of the battery pack housing 1060.

With reference again to FIG. 17, the batteries 1062 may optionally be secured to the axle 1064 within the battery pack housing 1060 via clips 1080 or other securement arrangements, such as straps. In one embodiment, it is contemplated that the clips 1080 are of a quick-release design to facilitate removal and replacement of the batteries 1062.

Floating Seat Position

Figure 19:
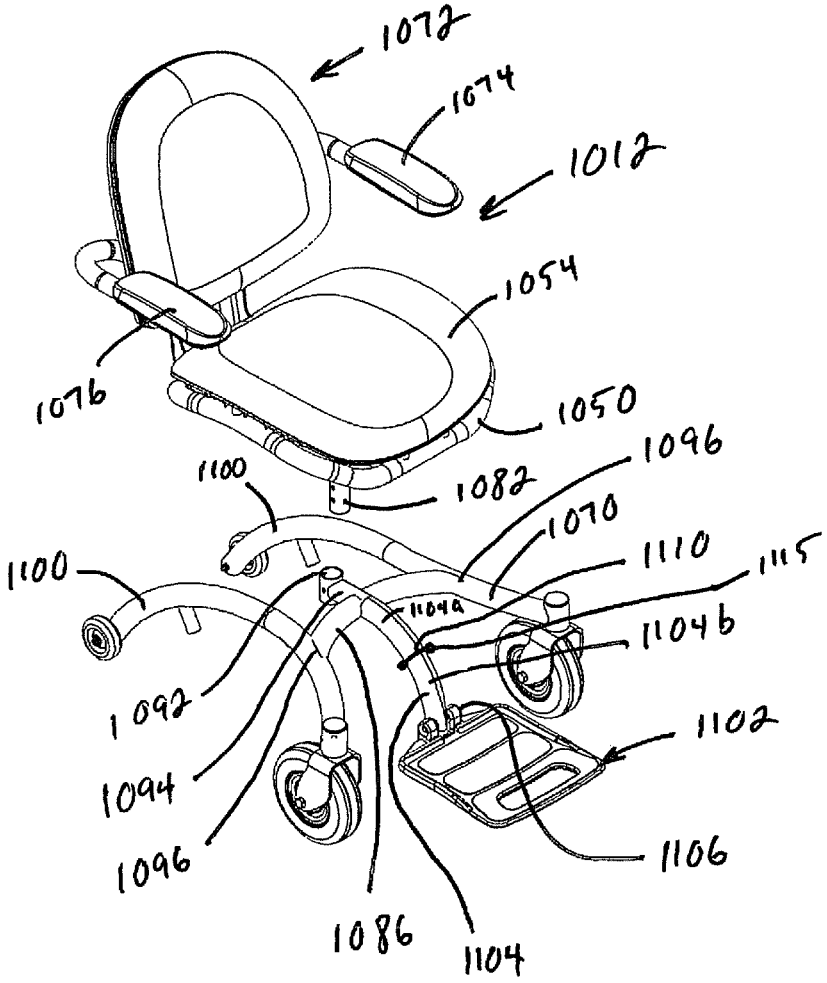
FIG. 19 is an exploded perspective view of a portion of the base section and a seat section of the conveyance illustrated by FIG. 11A.

With reference to FIGS. 14A and 19, a single post 1082 extends from the seat section 1012 of the wheelchair. The post 1082 includes a plurality of openings 1084 used for adjusting a height of the seat platform 1020. The base section 1014 of the wheelchair includes a front cross member 1086. As discussed above, the rear axle 1064 (see FIGS. 16A-16D) acts as the rear cross member.

The post 1082 is secured within a connection opening 1090 (FIG. 11B) on the base section 1014 of the wheelchair using, for example, a bolt 1092 that passes through an opening in the connection opening 1090 and the post 1082. The connection opening 1090 is secured to an extension 1094 that extends (e.g., rearward) from the front cross member 1086. Therefore, the seat section 1012 is secured to the base section 1014 at a single connection point. More specifically, the seat section 1012 is secured to only one of the cross members (e.g., the front cross member 1086). In one embodiment, the front cross member 1086 is curved to form a bowed appearance. The curved, bowed front cross member 1086 acts to position the connection opening 1090 toward a rear of the wheelchair (e.g., behind the points 1096 where the front cross member 1086 extends from side bars 1100 of the base section 1014).

In an alternate embodiment (not illustrated), it is contemplated that the connection opening 90 is integrated with the front cross member 1086. Therefore, in this alternate embodiment, the illustrated extension 1094 is eliminated. Although this embodiment does not include an extension between the front cross member 1086 and the connection opening 1090, it is contemplated that the front cross member is curved to extend farther rearward to eliminate the need for the extension 1094. Consequently, the connection opening would be similarly positioned toward the rear of the wheelchair without the extension 1094.

In either of the embodiments described above, the single connection point between the base section 1014 and the seat section 1012 provides the appearance that the seat section 1012 is "floating" over the base section 1014. Such a design contributes to a more unitary design, which results in a more appealing, sleeker, and less bulky appearance.

Foot Plate

With reference again to FIG. 11A, the wheelchair 1010 includes a foot plate 1102 for supporting a user's feet. In the illustrated embodiment, the foot plate 1102 is attached to a curved tube 1104 extending from the front cross member 1086. The curved tube 1104 extends toward a front of the wheelchair 1010. More specifically, the curved tube 1104 extends in an opposite direction from the extension 1094.

The curved tube 1104 extends downward (e.g., toward a floor) from the front cross member 1086. A pivotal connection 1106 pivotally connects the foot plate 1102 to the curved tube 1104 near a front, lower end of the tube 1104. The pivotal connection 1106 permits the foot plate 1102 to swing upward toward the curved tube 1104. More specifically, the foot plate 1102 may swing up and out of the way (e.g., rest on the curved tube 1104 under the seat section 1012) to provide easier access for an operator to enter and exit the wheelchair. It is to be understood that the pivotal connection 1106 includes a stopping means for maintaining the foot plate 1102 above the floor when the foot plate 1102 is extended fully downward (forward). It is contemplated that the foot plate 1102 and pivotal connection 1106 are sturdy enough to support the weight of an operator's feet while the operator is sitting in the wheelchair 1010.

When an operator desires to enter the wheelchair 1010, the operator may step on the foot plate and then sit down on the seat. Alternatively, the operator (or an assistant) may swing the foot plate 1102 upward (rearward) around the pivotal connection 1106 (toward the rear of the wheelchair 1010) until the foot plate 1102 no longer extends in front of the wheelchair 1010. For example, the foot plate 1102 may swing upward around the pivotal connection 1106 until the foot plate 1102 contacts the curved tube 1104 and appears to be tucked out-of-the-way under the seat section 1012. Once the operator is seated in the wheelchair 1010, the operator (or an assistant) swings the foot plate 1102 downward (forward) around the pivotal connection 1106 (toward the front of the wheelchair 1010) until the foot plate 1102 is fully extended in front of the wheelchair 1010.

Figures 20A, 20B, 20C:
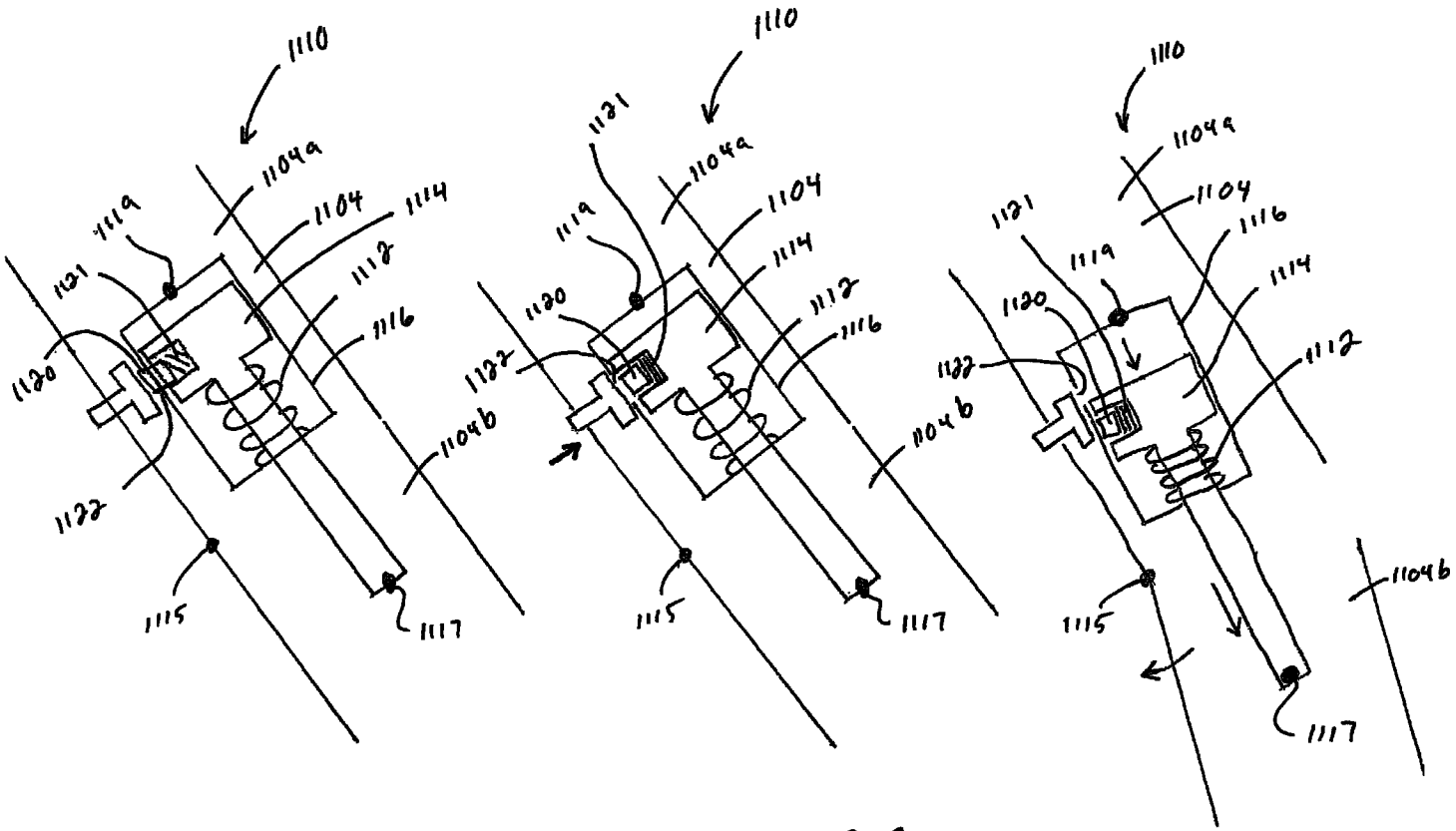
FIG. 20A is a schematic illustration of an exemplary embodiment of a pivotal connection in a latched state.
FIG. 20B is a schematic illustration of the pivotal connection of FIG. 10A in an unlatched state.
FIG. 20C is a schematic illustration of the pivotal connection of FIG. 10A in an unlatched and pivoted state.

In an alternate embodiment, it is also contemplated that an additional latchable connection 1110 is included along the curved tube 1104. The latchable pivotal connection may take a wide variety of different forms. Any arrangement capable of latching the footrest above the ground when the user is seated in the wheelchair and allows the footrest to drop to the ground when the user desires to enter or exit the wheelchair may be employed. For example, the connection 1110 may be a pivotal connection, a telescoping connection, a linkage, etc. With reference to FIGS. 20A-20C, the exemplary connection 1110 includes a spring 1112 that biases a piston 1114 to a retracted position within a cylinder 1116. The piston 1114 and cylinder 1116 are connected to upper 1104*a* and lower 1104*b* sections of the tube 1104 (illustrated as straight in FIGS. 10A-10C, but may be curved as shown in the other Figures) on opposite sides of a pivot connection 1115. For example, the piston 1114 may be connected to the lower section 1104*b* at a pivot point 1117 and the cylinder may be connected to the upper section 1104*a* at a pivot point 1119. The illustrated piston and cylinder arrangement may be replaced with any arrangement that provides a latching return to the pivot connection 1115. A release 1120 (e.g., a button) disposed in a recess of the piston 1114 extends through and engages an aperture 1122 in the cylinder when the button 1120 and the aperture 1122 are aligned. A spring 1121 may bias the button 1120 toward and through the aperture 1122 as shown in FIG. 20A. When the button 1120 extends through and is engaged within the aperture 1122, the piston 1114 is locked in place within the cylinder 1116. To allow the piston 1114 to move within the cylinder 1116 (as discussed in more detail below), the button 1120 may be depressed enough (FIG. 20B) so that the button 1120 no longer engages the aperture 1122 (i.e. the button clears the aperture). Once the button 1120 is no longer engaged in the aperture 1122, the piston 1114 may move freely within the cylinder 1116. When the piston 1114 moves freely within the cylinder 1116, the spring 1112 urges the piston 1114 back into the cylinder 1116 so that the button 1120 is urged toward the aperture 1122. Therefore, as discussed below, a force is required to urge the piston 1114 out of the cylinder 1116 (and urge the button 1120 away from the aperture 1122).

With reference to FIG. 20A, the curved tube 1104 is illustrated when the additional pivotal connection 1110 is in the latched position (i.e., the button 1120 is engaged within the aperture 1122). In this embodiment, when it is desirable for an operator to enter or exit the wheelchair 1110, the operator (or an assistant) depresses the button 1120 to disengage the button 1120 from the aperture 1122 (FIG. 20B). It is contemplated that the weight of the operator's feet will urge the piston 1114 out of the cylinder 1122 against the biasing force of the spring and, similarly, urge the button 1120 away from the aperture 1122. As the piston 1114 is urged out of the cylinder 1116, the additional pivotal connection 1110 pivots so that the foot plate 1102 tends to drop toward the floor (FIG. 20C). A protective sheath or boot may be provided over the upper and lower portions 1104A, 1104B of the tube at the pivot connection 1115 to prevent the possibility of pinching the user. Once the foot plate 1102 is on the floor, the operator may more easily enter or exit the wheelchair 1010. After the operator exits the wheelchair 1010 and the weight of the operator's feet is no longer on the foot plate 1102, the spring 1112 urges the piston 1114 back into the cylinder 1116 (and urges the button 1120 back through the aperture 1122) so that the button 1120 may once again be engaged in the bore 1122. On the other hand, after the operator enters the wheelchair 1010, the operator may lift his/her feet off of the foot plate 1102 so that the spring 1112 urges the piston 1114 back into the cylinder 1116 (and spring 1121 urges the button 1120 back through the aperture 1122) so that the button 1120 may once again be engaged in the aperture 1122.

Pivotal Seat Back

Figure 21:
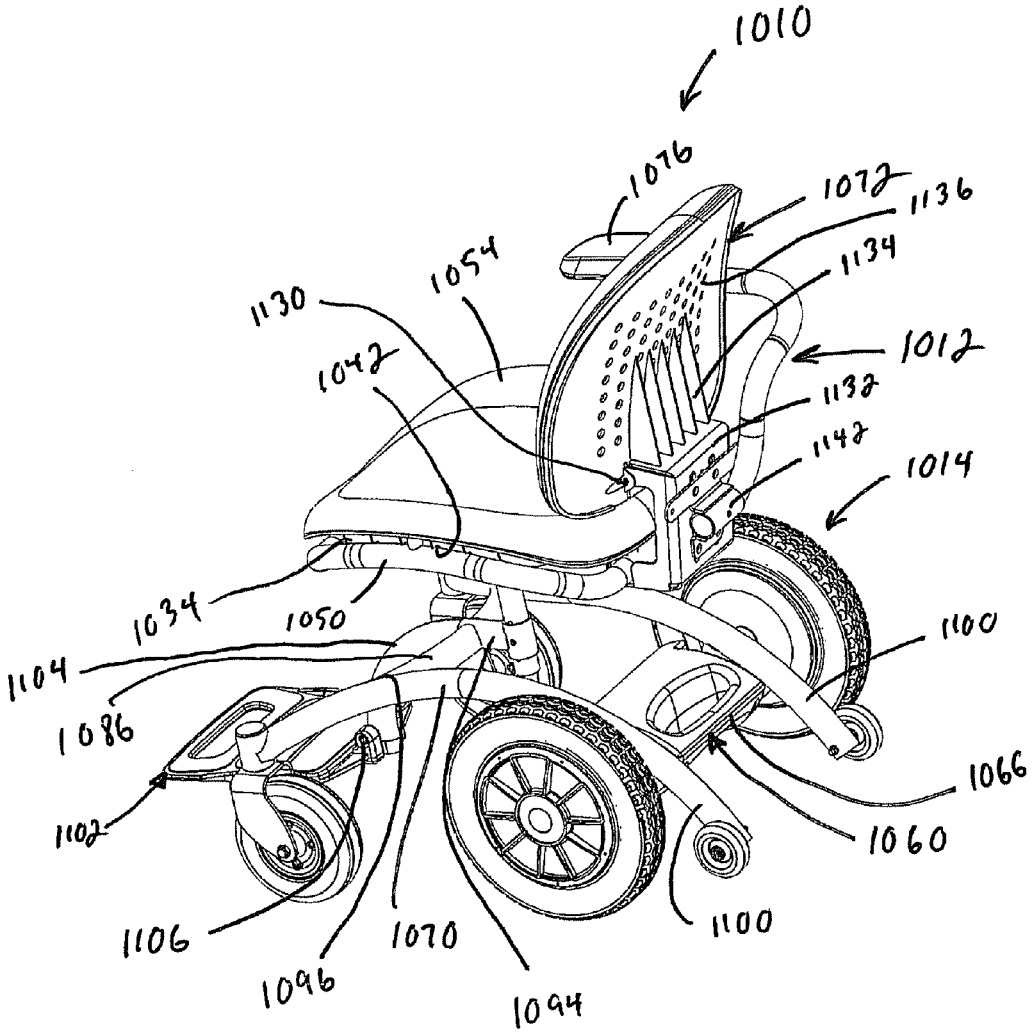
FIG. 21 is a perspective view of the conveyance of FIG. 11A without the left arm rest.

With reference to FIG. 21, a pivotal connection 1130 is provided between the seat back 1072 of the wheel chair 1010 and a bracket 1132 secured to the seat frame 1050. A plurality of ribs 1134 extend rearwardly from a back face 1136 of the seat back 1072. In one embodiment, each of the ribs 1134 is triangular shaped. A bottom face of each of the triangular shaped ribs 1134 is substantially flat. As illustrated, the flat, bottom faces of the triangular ribs 1134 bear against a top, flat surface of the bracket 1132 when the seat back 1072 is pivoted to an upright position.

The pivotal connection 1130 permits the seat back 1072 to freely pivot between the illustrated upright position and a folded position. The folded position is achieved by simply pushing the seat back 1072 forward toward the seat platform

1020. The range of the pivot for the seat back 1072 is defined by the position of the flat, bottom faces of the ribs 1134 relative to the flat surface of the bracket 1132 and by the position of the seat platform 1020. More specifically, the seat back 1072 may be pivoted forward until abutting the seat platform 1020. In addition, the seat back 1072 may be pivoted backward until the flat, bottom faces 1140 of the triangular ribs 1134 bear against the top, flat surface of the bracket 1132.

It is to be understood that although the pivotal connection 1130 permits the seat back 1072 to rotate freely, a person sitting in the wheelchair 1010 provides enough weight to keep the seat back 1072 in the upright position by simply resting his/her weight against the seat back 1072.

Arm Rests

Figure 22A:
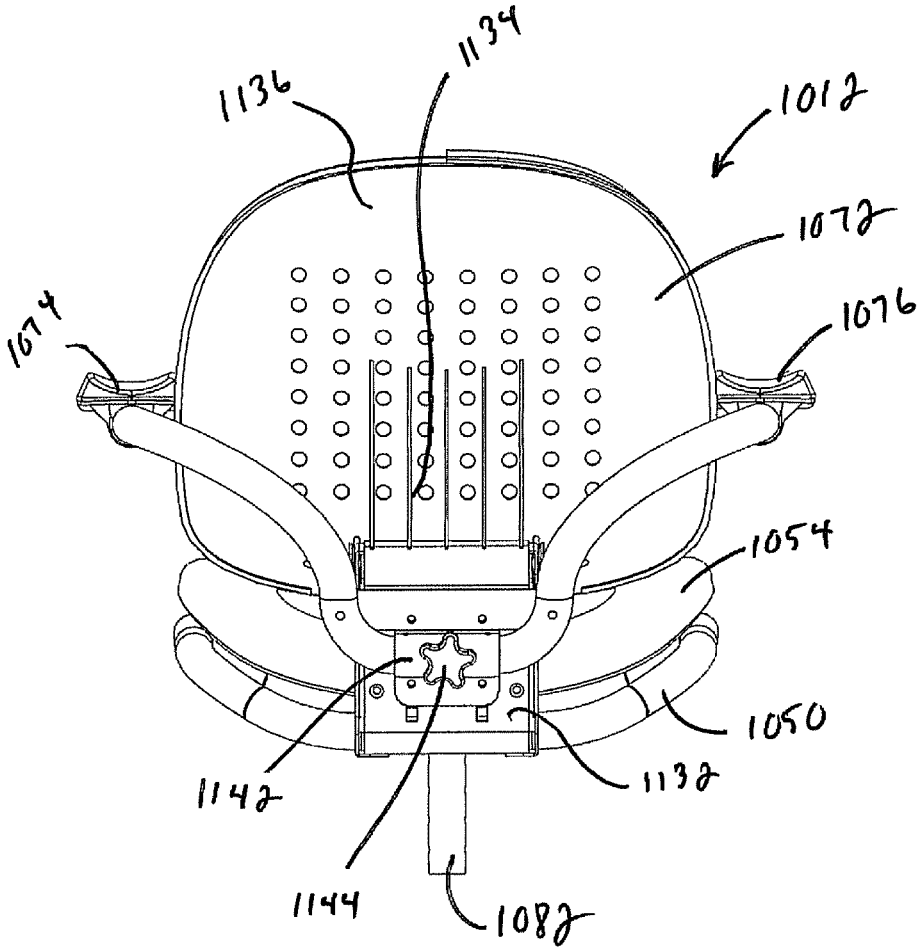
FIG. 22A is a rear view of the seat portion of the conveyance of FIG. 11A.
Figure 22B:
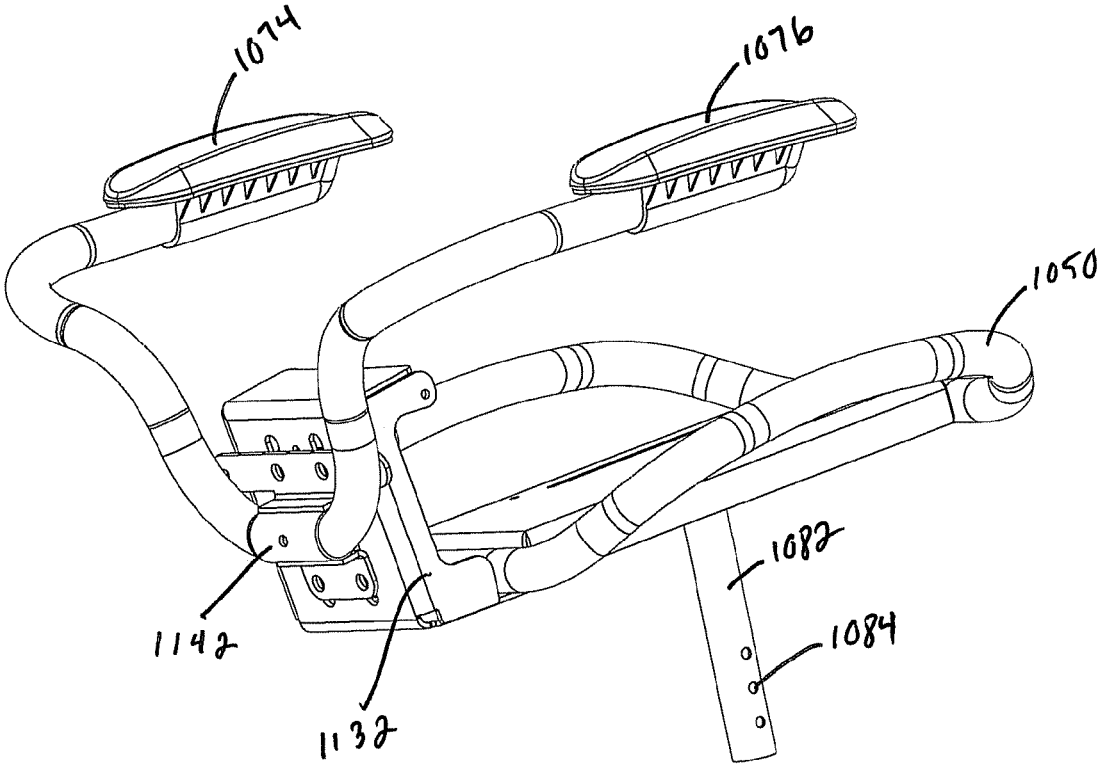
FIG. 22B is a rear perspective view of a frame of the seat portion of FIG. 22A.
Figure 22C:
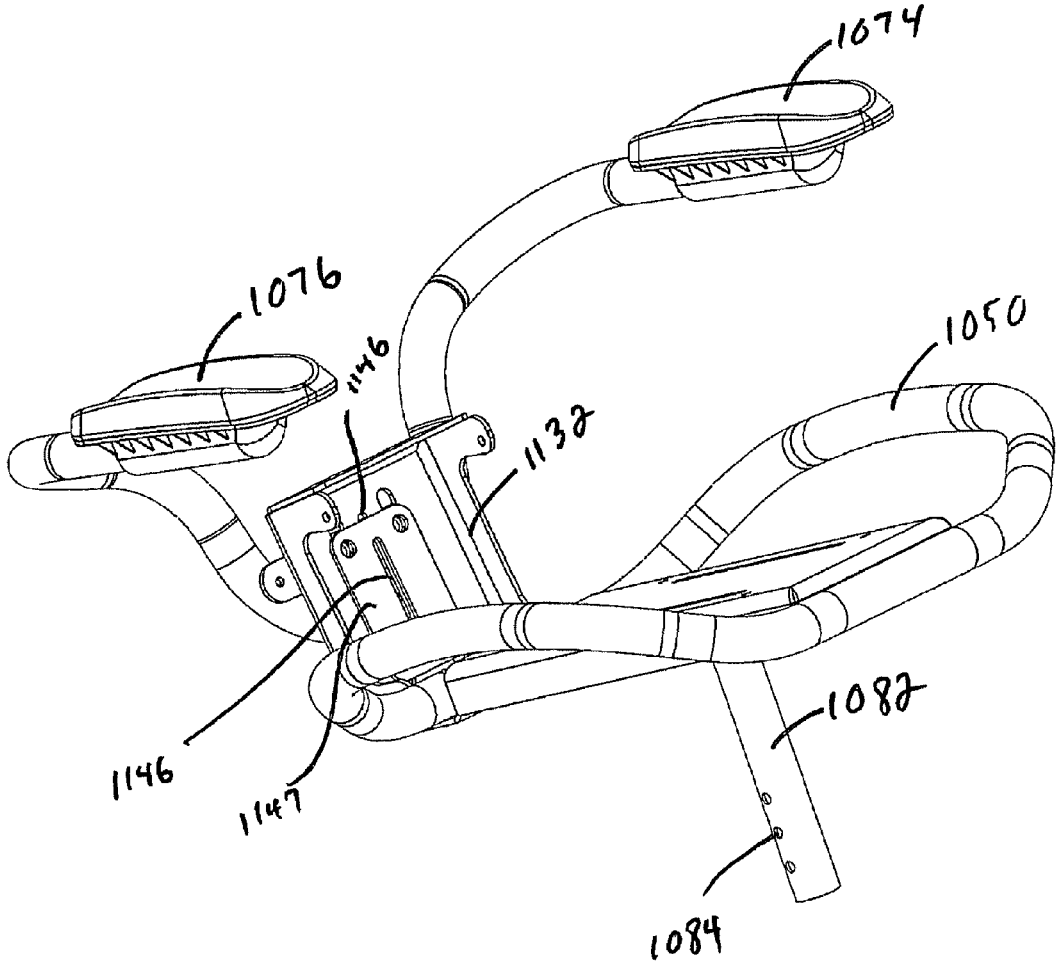
FIG. 22C is a front perspective view of a frame of the seat portion of FIG. 22A.

With reference to FIGS. 22A-22C, the left and right arm rests 1074, 1076, respectively, are secured at a common point 1142 on a rear face of the bracket 1132. Securing the arm rests 1074, 1076 to such a common point contributes to a more unitary design, which results in a more appealing, sleeker, and less bulky appearance.

In one embodiment, a bolt passes through a vertical slot 1146 (FIG. 22C) in the bracket 1132. A knob 1144 (FIG. 22A) is secured to one end of the bolt on one side of the bracket 1132, while a flange 1147 is secured to the other end of the bolt on the other side of the bracket 1132. The knob 1144 and the flange act to retain the bolt in the slot 1146. When the knob 1144 is tightened, the arm rests 1074, 1076 are frictionally held in place between the bracket 1132 and an arm rest bracket 1146.

If it is desired to raise or lower the arm rests 1074, 1076, the knob 1144 is loosened so that the bolt and the arm rests 1074, 1076 may be freely moved in a vertical direction within the slot 1146. Once the desired height is achieved for the arm rests 1074, 1076, the knob 1144 is tightened. The illustrated design permits both the left and right arm rests 1074, 1076 to be adjusted simultaneously by making a single adjustment via the knob 1144.

It is also contemplated that the left and right arm rests 1074, 1076 may be pivoted around the common point 1142. More specifically, if it is desired to move one or both of the arm rests 1074, 1076 away from the seat portion of the wheelchair, one or both of the arm rests 1074, 1076 may be swung (pivoted) about the common point 1142 so that one or both of the arm rests 1074, 1076 is behind the seat back 1072. Such a configuration may be desirable to facilitate certain operators from entering or exiting the wheelchair 1010.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the energy source or batteries can include an onboard charger unit, the casters can be coupled to pivot arms via shock absorbing fork assemblies, and the specific locations of the component connections and interplacements can be modified. Still further, while cylindrical or elliptical tubular components have been shown and described herein, other geometries can be used including polygonal (e.g., square, rectangular, triangular, hexagonal, etc.) can also be used. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A wheelchair frame comprising:

a j-shaped central frame member, wherein an arcuate portion the j-shaped central frame member is generally disposed in a downward direction;

first and second caster support members permanently fixed to and extending from the j-shaped central frame member, wherein the caster support members collectively form a "V" or "U" shape that extends upwardly and away from the j-shaped central frame member;

first and second drive wheel support members permanently fixed to and extending from the j-shaped central frame member, wherein the drive wheel support members collectively form a "V" or "U" shape that extends downward and away from the j-shaped central frame member;

wherein the j-shaped central frame member is disposed substantially along a centerline of the wheelchair frame.

2. The wheelchair frame of claim 1 wherein the j-shaped central frame member is a tube.

3. The wheelchair frame of claim 1 wherein the caster support members are disposed proximate a forward portion of the j-shaped central frame member.

4. The wheelchair frame of claim 1 wherein the drive wheel support members are disposed proximate a central portion of the j-shaped central frame member.

5. The wheelchair frame of claim 1 further comprising a seat support member disposed on the j-shaped central frame member.

6. A wheelchair comprising:

a frame that includes:

a j-shaped central frame member, wherein an arcuate portion of the j-shaped central frame member is generally disposed in a downward direction;

first and second caster support members permanently fixed to and extending from the j-shaped central frame member, wherein the caster support members collectively form a "V" or "U" shape that extends upwardly and away from the j-shaped central frame member;

first and second drive wheel support members permanently fixed to and extending from the j-shaped central frame member, wherein the drive wheel support members collectively form a "V" or "U" shape that extends downward and rearward from the j-shaped central frame member;

wherein the j-shaped central frame member is disposed substantially along a centerline of the wheelchair frame;

first and second front caster assemblies connected to the first and second caster support members respectively;

first and second drive wheels connected to the first and second drive wheel support members respectively; and a seat assembly connected to the j-shaped central frame member.

7. The wheelchair of claim 6 wherein the j-shaped central frame member is a tube.

8. The wheelchair of claim 6 wherein the caster support members are disposed proximate a forward portion of the j-shaped central frame member.

9. The wheelchair of claim 6 wherein the drive wheel support members are disposed proximate a central portion of the j-shaped central frame member.

10. The wheelchair of claim 6 wherein the drive wheel support members collectively form a "V" or "U" shape that extends downward and away from the j-shaped central frame member.

11. The wheelchair of claim 6 further comprising a seat support member disposed on the j-shaped central frame member.

* * * * *